US005829255A

United States Patent [19]

Sitnyakovsky et al.

[11] Patent Number: 5,829,255

[45] Date of Patent: Nov. 3, 1998

[54] SYSTEM AND METHOD FOR DIRECT-CONTACT CONDENSATION WITH CONDENSATE IN STEAM-TURBINE POWER PLANTS EVAPORATORS

[76] Inventors: Roman E. Sitnyakovsky, 930 N. Spaulding Ave., #8, Los Angeles, Calif. 90046-6359; David Z. Zingerman, 1934 1/2 Cheremoya Ave., Los Angeles, Calif. 90068

[21] Appl. No.: 882,862

[22] Filed: Jun. 26, 1997

[51] Int. Cl.[6] ..... F01K 19/10

[52] U.S. Cl. ..... 60/688; 60/654

[58] Field of Search ..... 60/641.1, 654, 60/688, 692

[56] References Cited

U.S. PATENT DOCUMENTS 2,356,404 8/1944 Heller .
2,951,687 9/1960 Schulenberg et al. .
3,575,392 4/1971 Stoker et al. .

*Primary Examiner*—Noah P. Kamen
*Attorney, Agent, or Firm*—Ladas & Parry

[57] ABSTRACT

A system and method for direct-contact condensation with condensate, cold, and heat supplies in steam-turbine power plants, evaporators, and other heat-and-mass transfer equipment having a condenser. Outside snow/ice collectors accumulate and store snow, atmospheric ice, and condensate for transporting the snow/ice coolant to an inside storage area when needed. The snow/ice from outside delivery and from the inside storage area is transported into a hard foreign matter separator. A grinder prepares an atmospheric ice powder to spray into a condenser. A vacuum exhaust pump/air ejector evacuates cold air from a condenser well for a vacuum support and for cooling uses. A condensate pump transports icy condensate from the condenser well to the inside storage area. Filters catch a mud from condensate for feed-water protection from impurities. From the inside storage area icy condensate is transported to customers for cooling and other purposes, at warm weathers, and to the outside snow/ice collectors for freezing to ice in the future. The same pipelines, pumps, and valves transport a hot condensate from a steam-extraction heater or from a boiler to customers for heating and other purposes, at cold weathers. A return condensate from customers is transported to a boiler-feed pump and to a spillway basin, which also stores precipitation. Customers may remove the condensate from the pipelines or from the spillway basin. The boiler-feed pump transports condensate to a deaerator, to the boiler, and to the steam-extraction heater. At cold weathers, condensate may be frozen in outside snow/ice collectors, inside storage are, and spillway basin, for use in the future.

20 Claims, 3 Drawing Sheets

FROM CONVEYOR 7 AND VICINITY
28
6
13
8
13
13
8
STEAM
2
20
19
20
1
13
COLD AIR
TO AIR-CONDITION
AFTER VACUUM
EXHAUST PUMP
9
12
13
13
TO INSIDE STORAGE 3

SYSTEM AND METHOD FOR DIRECT-CONTACT CONDENSATION WITH CONDENSATE IN STEAM-TURBINE POWER PLANTS EVAPORATORS

TECHNICAL FIELD OF THE INVENTION

Condensers are used to convert a gas or vapor into its liquid phase (condensate), to transfer the gas/vapor latent heat of evaporation/condensation into a relatively cooled fluid (a coolant), to collect the condensate in a receiver (condenser well), and to transport the liquid to a point of use, where it can be reused or removed for other applications.

Condensers have wide-spread industrial usage and application. By way of examples of the wide scope of applications in which condensers are needed, consider the fact that condensers are used in steam-turbine power plants, in evaporators for the condensation of exhaust steam or other vapors, in refrigeration plants for the condensation of refrigerant vapors (such as freon or ammonia), in the petroleum and chemical industries for the condensation of hydrocarbons and other chemical vapors, and in stills for purifying water or alcohol.

The present invention relates, in one aspect thereof, to direct-contact (or jet, spray, or mixing) condensers employed particularly for condensing the exhaust steam of steam turbines, evaporators, contact apparatus, heat exchangers, and/or other related heat-and-mass transfer equipment having a condenser.

The present invention, in another aspect, provides for the supply of cold or heat for service or domestic cooling, air-conditioning, and heating, and condensate for different plant and customer needs.

This technology is commonly used in the power, petroleum, chemical, light, food, manufacturing, pharmaceutical and other industries.

The present invention provides for effective condensing by means of direct-contact heat exchange between equipment exhaust steam and the coolant, and to the accumulation of condensate (salt-free water) in storage areas for profitable usage. Here everywhere the coolant of present invention is named "snow/ice" which is actually an indefinite composition of snow, atmospheric ice, glacier snow, and icy condensate.

Still more specifically, this invention relates to a new type of direct-contact condenser which is relatively simple in construction and highly efficient and reliable in operation.

The present invention, in another aspect, provides a new method of useful and profitable usage of precipitation in the above-mentioned equipment.

This invention also relates to decreasing the negative aspects of condenser operation and to decreasing the danger and damages of flooding upon the melting of snow in an environment.

BACKGROUND OF THE INVENTION

Though this invention may be used to condense any suitable gas by any suitable coolant, it is particularly useful to condense steam in power plants.

Modern thermal power plants are equipped with turbo-generators of high output powered usually by steam turbines. In a "typical" steam turbine-generator power plant, the exhaust steam from a low pressure turbine and other "dead" steam is precipitated in a heat exchanger called a "condenser", giving up its latent heat of evaporation to a coolant (usually water) which flows through the equipment, and reducing in volume by many hundreds of time, which creates a vacuum. This vacuum increases the drops of enthalpy, pressure, and temperature in the turbine, resulting in greater plant efficiency.

In the Rankine (or similar) cycle, latent heat of evaporation/condensation is the waste of heat energy in condensers. It is about two-thirds of total steam enthalpy and also creates undesirable warming of the environment when significant amounts of heat are released to the atmosphere from steam systems. It has not been economically feasible to reclaim this energy with known technology. The present invention offers such a technology.

Condensers are costly in capital investment as well as in operating requirements. The present invention can help diminish these costs.

Two main types of steam condensers are now in use in power plants and in similar environments: a) surface condensers in which the condensing steam does not come into direct contact with a coolant (usually water), but is separated from the coolant by the walls of a series of tubes within a shell, the steam passing through the shell in a heat exchange with the water flowing through the tubes; and b) direct-contact condensers in which water is sprayed into the steam and intermingles with it, thereby creating condensation and vacuum.

With any steam condenser, the condenser vacuum, turbine enthalpy drop, and turbine power are increased with a decrease of coolant temperature.

In shell-and-tube (surface) condensers, since the coolant is isolated from the steam during heat transfer, the condensed steam is relatively free from air and other non-condensibles which are present in the coolant and which are undesirable since such non-condensibles can cause corrosion and other damage, as well as "blanket" the condenser, thereby reducing its effectiveness. However, shell-and-tube heat exchangers are relatively expensive to manufacture and relatively inefficient at heat transfer.

Surface condensers are mainly used when there are differences between the chemical and physical properties of the condensed steam and its coolant. If the coolant in direct-contact condensers is "hard" water (containing carbonates, magnesia, etc.), fouling appears on the inside walls of tubes in equipment (such as boilers, evaporators, heat exchangers, etc.) for a "closed cycle" (e.g. if the same volume of water constantly recycles through the boiler to the turbine, to the condenser and back to the boiler).

On the other hand, metal walls of surface condenser tubes create thermal and hydraulic resistances to heat exchange between the steam and the cooling water. Also, fouling can appear on the inside walls of these condensers' tubes. Thermal conductivity of the fouling is approximately 10 times less than of the metal, so the overall heat-transfer coefficient through the tube walls, and therefore the heat transfer rate and capacity of the surface condenser are decreased significantly with fouling. Fouling also reduces the vacuum created by steam condensation, reduces the drop of steam temperature, pressure, and enthalpy in the condenser, and reduces the steam temperature, enthalpy, and pressure after the boiler, thus reducing the turbine enthalpy drop. All of these effects cause a reduction in efficiency of the equipment. Fouling presents a problem which may disorganize any technological process implementing heat exchange. Fouling is one of the main unsolved problems for heat-transfer equipment. In the world steam-power industry, an expensive chemical treatment of water is used to fight fouling. The present invention provides a solution for the problem of fouling.

Cooling water for surface condensers typically comes from a river or the like, and for that reason, power stations are usually located beside a body of water. However, in some geographical areas, water is not so readily available in such quantities as are required by power plants presently being planned. Therefore, it is desirable that alternate methods of steam condensation be used in such water-scarce areas. The present invention addresses this problem as well.

Very often, for economical and environmental reasons, after running through the surface condensers, the cooling water is cooled with ambient air in special heat exchangers (e.g. cooling towers) and then recirculated back to the condensers. The resulting twofold temperature difference and heat exchange increases the condensation cost, increases the temperature of cooling water entering the surface condensers, thus reducing the steam condensing vacuum, enthalpy drop, power, and efficiency of the turbines.

The relatively high cost, high fouling rate, low efficiency and large sizes of shell-and-tube (surface) condensers do not make them feasible for many systems. The present invention overcomes some of the problems inherent in surface condensers.

A direct air surface condenser is a heat exchanger in which steam passing on one side of the condenser directly gives up heat to air passing on the other side of the condenser. In a direct air condenser, there is but a single heat exchange and a single temperature difference between the condensed steam and the ambient air. Size, however, is a limiting factor for direct air condensers due to the low heat-transfer coefficient between steam and air. A typically-sized central station turbine requires a direct air condenser of such size as to make the system uneconomical in many applications. Furthermore, the problem of diffusing the full turbine flow to such an air condenser makes a system of condensing turbine steam solely in direct air very difficult. An example of such a condenser is shown in U.S. Pat. No. 2,951,687 to Schulenberg et. al. In this system, turbine exhaust steam passes into a direct air condenser in which the cooling medium is air. In normal operation, the circulating air is the only coolant used in the condensing system. Under certain conditions, where the ambient air is below a preselected temperature, the resulting condensate is considered to be "too cold", and some of it is recirculated and sprayed into direct contact with turbine exhaust steam. This has the effect of condensing a small portion of the steam and of heating up the recirculated condensate. In effect, this is a first stage of feed-water heating. There is no need for air condensation and water heating in the condenser in the present invention.

The efficiency of steam turbines may be increased by increasing heat transfer (i.e. the heat-transfer coefficient, the heat-transmission surface, and the temperature difference between the steam and a coolant in a condenser). Such an increase is considerably greater in mixing (direct-contact) condensers than in surface condensers. Undesirable effects on the environment and the waste of heat energy are considerably less for mixing than for surface condensers.

In direct-contact steam condensers, a coolant (usually water) is directly mixed with exhaust and other "dead" steam to condense the steam. In these arrangements, water is discharged into the condenser shell in the form of one or more streams of finely divided droplets in the path of the steam to condense the steam and to heat the water. As a result, a relatively high degree of heat transfer is possible.

Direct-contact condensers are used in steam plants (e.g. electric power plants), which are located in areas where it is difficult to obtain sufficient cooling water. Direct-contact condensers are also used in geothermal power plants in which there is no need to recycle the steam condensate to steam generators. Because the direct heat exchange provides relatively high efficiency in the utilization of the coolant, it is particularly useful in these aforesaid applications. The present invention may considerably increase the field of applications for direct-contact condensers.

In spite of the advantages of direct-contact (mixing) condensation, it has not been in wide use in steam condensers since James Watt's time (two centuries ago). Mixing condensers have been developed simultaneously with the steam engine. They serve the purpose of condensing the low power exhaust steam issuing from a steam engine or turbine under vacuum. Owing to the elimination of the steam engine from the field of power generation, and furthermore in consequence of the quality of the feed-water requirements in connection with modern boilers, which feedwater must be prevented from mixing with the cooling water to prevent a contamination of the condensate (feed water) and fouling, direct-contact condensers have been steadily losing ground. If a "hard" cooling water is mixed with the condensing steam, which is itself a valuable raw material, the working substance in the Rankine cycle—condensate (equivalent to distilled or "soft" water) is lost. Specifically, because in any condenser one needs many times more mass of coolant than mass of condensed vapor, the chemical and physical composition of the condensate/"hard" coolant mixture after direct-contact condensation would actually be the same as the "hard" coolant. The present invention does not require that such a "hard" mixture be created.

Direct-contact arrangements suffer from the fact that the air from the coolant liberates in the shell and must be removed to prevent a vacuum drop in the condenser, and to reduce corrosion, the above-mentioned "blanketing" and other deterioration of the equipment. The removed air may be used as a profitable coolant in the present invention.

Conventional direct-contact condensers also suffer from inherent efficiency problems. For example, a water spray condenser is a heat exchanger in which the latent heat of exhaust steam heats the jet spray-water. Thus there is a temperature rise in the jet spray-water as it absorbs latent heat from the steam, thereby condensing the steam. Accordingly, there is necessarily a temperature differential between the exhaust steam and the jet spray such that even when the spray is heated by the steam, there remains a temperature spread between the exhaust steam and the highest spray-water temperature. This temperature differential must be present for the heat to transfer from the steam to the spray water. A jet spray condenser is most effective at the point where steam enters it. As the steam travels through a jet spray condenser, the sprays, the condensing and cooling steam, and the rapid volume decrease cause turbulent or erratic flow within the condenser. Thus, at the later stages of the condenser (that is, farther downstream from the exhaust) there is a smaller temperature differential between the spray water and the steam, and, in general, less heat-exchange effectiveness. As a result, in a system employing only a jet spray condenser, the great bulk of the steam is condensed in only a relatively small physical portion of the condenser. In other words, the law of diminishing returns applies: the lower or last stages of a jet spray condenser produce relatively little condensate per unit of coolant spray. The facts that there is no temperature rise of the coolant during condensation in the present invention, and the condensation temperature in the present invention is considerably lower than in any water spray condenser, help to avoid such disadvantages.

Conventional direct-contact water-spray mixing condensers also introduce significant system equipment limitations. In a water-spray direct-contact condenser, cooling water is supplied by means of nozzles under suitable pressure. These nozzles form cooling water into minute drops, thereby greatly increasing the water surface which comes into contact with the steam and producing an intimate mixture of steam and cooling water. In this type of condensation, it is generally required to have a high cooling water pressure to assure proper atomization of the cooling water. This in turn makes it necessary to expend much power in the cooling water's circulatory pump. In the case of a heavy-duty plant, this necessity is apt to bring with it equipment parameters of a type that render the plant uneconomical. The present invention can help eliminate this problem as well.

Yet another disadvantage of conventional direct-contact condensers stems from the type of cooling spray generally required in these condensers. For the purpose of satisfactory heat transfer in direct-contact condensers, the requisite contact surface between the water and the steam is very high. To achieve high contact surface dimensions, water drops having comparatively low dimensions (fine droplets) must be produced, but this is possible only at high water-spray velocities. High water-spray velocity decreases the contact time between the water and the steam and therefore reduces the condenser's heating efficiency. Either the duration of time during which the water drops remain in the condenser is reduced to such an extent that the drops cannot be heated as required, or the volume of the condensers must be enlarged to make certain that the water drops will stay a sufficiently long time in the condenser. In order to provide a rather long steam-cooling water path (by enlarging the volume of the condensers), the condenser must be of a relatively large size and cost to insure the requisite heat transfer. The present invention helps to eliminate this disadvantage.

It has been found experimentally that the predominant portion of a direct-contact condenser's heat exchange (in the case of water nozzles mounted in the steam chamber) takes place in the film phase which precedes the phase wherein the cooling water is broken down into drops. Accordingly, the atomization of the cooling water into drops is not required from the standpoint of heat transfer; and the nozzles could be used in such a manner as to bring about the occurrence of only a film phase. The present invention avoids the disadvantage of failing to employ a film or a drop phase in a direct-contact condenser.

Another disadvantage of conventional jet spray condensers relates to a common manner in which the condensate/cooling water mixture is cooled. The conventional jet spray condenser is often combined with an air cooler to cool the water as it is recirculated and before it is again sprayed into the condenser. As mentioned earlier, in order for the air to be effective to cool the spray water, there must be another and similar temperature differential between the spray water and the ambient air to which the water gives up heat in the air cooler. Therefore, in a jet spray condenser system, there must be a twofold heat exchange and two temperature differentials between the condensing steam and the ambient air. In the case of such equipment, the steam exits from e.g. a turbine, and is condensed in a mixing condenser where the exiting steam is cooled by cooling water. The cooling water, which is thereby heated, is again cooled in a large heat exchanger by means of outside air, and is rerouted into the mixing condenser, for the purpose of repeated use for condensation. The water necessary for feeding the boiler is likewise taken from this mixture of cooling water and condensate. Since, in this instance, the condensate employed as cooling water is of the quality of feed water, the feed water will not suffer deterioration in quality by being mixed with the cooling water. The present invention does not require any air cooler.

At the present time and in light of the above-described limitations, spray condensers are used to an appreciable extent only in conjunction with chemical apparatus, particularly evaporation plants, and in geothermal power plants.

The types of designs of mixing condensers known up to the present date are not suited for use in connection with heavy-duty steam turbines for a number of reasons. They can be classified in a number of categories.

One of the most widespread categories embraces the plate condenser, in which tandem fitted plates are provided along the path of the flowing cooling stream, whereby the cold water is supplied at the upper plates, propagating with the steam in a direct or counter-current manner. The space requirement for mixing condensers of this type is very high, in addition to which the plate condenser design also requires a high flow resistance in view of the rates of flow of the steam in modern condensers. The present invention is indifferent to the direction of steam and coolant flows, thereby eliminating the aforementioned problems.

Another familiar type of mixing condenser is represented by the Waringhouse-Leblanc system, in which mixing nozzles are employed. The cooling water, which flows at a relatively high velocity, and the steam which is to be condensed are forced by the nozzles into a mixing chamber. This type of condenser is suited for condensation of appreciably higher quantities of steam than plate condensers, yet still requires a much larger space than is desirable or possible with the present invention.

For example, in the direct-contact condenser disclosed in U.S. Pat. No. 3,575,392, steam drained from a turbine enters at the top portion of a housing and flows downwardly over the full length at the widthwise-middle portion of the housing. A baffle member is used to divide and change the direction of this downward flow in generally lateral opposite directions toward the widthwise-end walls of the housing. These lateral flows then generally change direction and travel collectively upwardly over the full length of the housing at both widthwise side portions of the housing. These collectively upward flows are made to travel a tortuous path. Streams of cooling water fall in these upward flow zones to cause direct heat exchange. Condensate drops down, is temporarily accumulated in the bottom of the housing, and is then drained along with the cooling water. The non-condensible gases are exhausted from the top portions of the upward flow zones.

Improvements have been made to reduce the size of such condensers. These improvements depend on the fact that the downward steam flow immediately following the entrance has a relatively high speed (such as, for example, 100 meters per second). If cooling water is supplied to such a high speed steam flow, the water is converted to a mist which provides good direct-contact heat exchange. Accordingly, devices for supplying water to the downward steam flow have been designed. Such measures are not necessary in the present invention, which is indifferent to the flow direction.

When the load on the steam equipment is reduced, the amount of drained steam therefrom is also reduced. It is necessary in devices having water injection in the downflow stage to stop supplying water to this stage in periods of reduced steam flow, because the kinetic energy of the steam in the upward steam flow stage is reduced due to condensation in the downward flow stage to such a point where insufficient kinetic energy is available to obtain good heat-exchange efficiency in the collective upward-flow stage. Although this problem has also been taken into consideration in the prior art devices, operation of such devices has not been stable. The present invention does not suffer from this problem.

One alternative method of steam condensation is shown in U.S. Pat. No. 2,356,404 to Heller. In the Heller system, turbine exhaust steam passes into a condenser in which it is directly contacted with a cool water spray. The spray water and condensate is then collected in a hot well from which a portion is pumped back to the boiler and a portion is recirculated to an air-cooled cooler and then back to the condenser injection or jet sprays. The present invention does not need any such cooling or recirculation of condensate.

The aforementioned systems of steam condensation are, in fact, air condensers since they use air as the ultimate coolant or heat sink. By their very natures, they have limitations, which it is the object of the present invention to overcome.

In summary, the known mixing condensers, as above-described, are unsatisfactory for mixing condensation with modern heavy-duty steam turbines. An important object of the present invention is to provide an improved mixing condenser which is suitable from the standpoint of design for and with heavy-duty steam turbines and other heat-and-mass transfer equipment having a condenser.

It is the aim of this invention to utilize a system which provides a method for direct-contact condensation for steam-turbine power plants, evaporators, and other heat-and-mass transfer equipment having a condenser, while providing condensate, cold and hot water supplies to customers, decreasing negative environmental aspects of condensers' operation, and decreasing flood dangers upon melting of snow in an environment.

BRIEF DESCRIPTION OF THE INVENTION

To overcome the disadvantages of the aforementioned systems, a new and improved direct-contact condenser is proposed which is simpler, smaller, cheaper and easier to maintain than other types of mixing condensers, realizes the advantages of each type of direct-contact condenser and overcomes the inherent limitations of each. The present direct-contact condenser also increases vacuum in the condenser, resulting in increased power-plant electrical, thermal, and economical efficiency. In addition, the present invention's system provides a new effective method for the profitable usage of annual precipitation and decreases the danger of flooding after melting of snow in an environment.

In comparison to existing direct and indirect-contact condensers, the direct-contact condenser of the present invention offers: the creation of stronger vacuums, the production of useful condensate and heat-transfer agents, lower thermal and hydraulic resistances, reduced negative consequences of flooding after melting of snow in an environment, minimal to no system fouling, avoidance of "hard" water in the system employing the condenser, and fewer condenser system elements (e.g. no tube banks, circulating water and water treatment systems, etc.).

Snow becomes a saleable article by virtue of using the present invention.

The basic idea of the invention is to replace a surface (indirect-contact) condenser for many types of equipment with direct-contact condensation, and to replace "hard" water as a coolant with "soft" and cooler snow/atmospheric ice (i.e. ice originating from salt-free snow, rain, or condensate, but not from seas, rivers, lakes, and the like). Contrary to water as a coolant, the snow/ice coolant provides the same (32 degrees F.) temperature of condensation at any season and weather outside the system.

For example, when the present invention is employed in steam-turbine power plants, an atmospheric ice powder is mixed with the turbines' exhaust steam in the condensers and in the last stages of existing, already installed turbunes, at an overload. The icy condensate is then pumped from a condenser well to an inside snow/ice/icy condensate storage area. At warm weathers/temperatures, the icy condensate may be pumped via a first series of pipelines, pumps and valves from this storage area to customers desiring cold water (for cooling, air-conditioning or other purposes), and/or to at least one outside snow/ice collector to be frozen in the future. After the customers, the condensate via a second series of pipelines, pumps, and valves returns at higher temperatures to a spillway basin and/or to a boiler-feed pump. At cold weathers/temperatures, these same first and second series of pipelines, pumps, and valves may be used when desired to transfer a hot condensate from a boiler or from the turbine's steam-extraction heater to customers desiring hot water (for heating or other purposes) and back to the steam plant. Condensate in the pipelines and/or stored in the spillway basin may be delivered to customers desiring condensate, to the boiler-feed pump for the boiler's feed-water supply, and/or to the turbine's steam-extraction heater.

During steam condensation via direct contact between steam and atmospheric ice powder, the steam latent heat of condensation/evaporation is not wasted in the condenser, but is instead used to melt the ice, thereby generating an additional vacuum and electrical power from the same amount of fuel, and to simultaneously produce the coolant which can be sold.

In this system, the economy of a conventional fuel for boilers or reactors makes snow and atmospheric ice like a new kind of constantly-replenished "fuel" which is cheap and open to general usage. Here also it is possible to make profit from snow taken from cities, towns and roads during winter snow removal, to benefit from a reduction of the negative aspects of condenser operation on an environment, and to reduce the dangers and damages from flooding after snow melting on an environment.

Snow/atmospheric ice may be as "soft" as steam, so their liquid mixture will also be "soft"—appropriate to boiler (or other heat-and-mass transfer equipment) water-feeding without a danger of a fouling, i.e. with no need of feed-water chemical treatment.

The mass of snow/ice required for direct-contact condensation may be considerably less than the mass of circulating water required for any direct or indirect-contact condensation of the same amount of steam, because the latent heat of snow/ice melting is much more than the specific heat of water. In other words, a mass of snow/ice condenses much more steam than the same mass of water, and condenses steam at significantly lower temperatures and enthalpies (i.e. at higher vacuums).

Used as a direct-contact condensation coolant, snow/ice reduces the condensation temperature by over 70 degrees Fahrenheit more than when a "hard" water in indirect-contact condensers is employed. This increases the overall efficiency of the Rankine cycle, of the equipment, and therefore, of the system itself. Furthermore, icy condensate is a useful coolant for industrial, service, and domestic needs, a valuable raw material.

By collecting and storing a large cold supply in the form of snow/atmospheric ice/icy condensate (which may be constantly supplemented by precipitation from the environment and delivery from outside) in snow/ice collectors and a supply of snow/ice delivered by providers to the condenser for all-the-year-round usage in the condenser, one makes the system permanently workable, cuts down expenses, and increases efficiency of the entire system.

Collecting and storing return condensate from the system and rain precipitation from the vicinity (the return condensate and the rain precipitation are chemically and physically the same substance) in the spillway basin provide a source of condensate (and an additional source of atmospheric ice after freezing of these water sources in winter). These generally salt-free ("soft") water sources are a good solvent and a valuable raw material for water-supply and industrial (e.g. in chemical, food, light, etc. industries) needs. They are also a source for compensating condensate losses in the system; for boiler water-feeding without a chemical treatment of the water.

A loader and a thermoinsulated bulk-load conveyor deliver snow/ice from the inside storage area to a hard foreign matter separator together with a direct snow/ice delivery. The separator prevents stones, asphalt, and similar foreign matter from entering a grinder and the system after the grinder. Actually, almost all such foreign matter cannot leave the outside snow/ice collectors and overcome the mixer, remaining there.

Impurities which cannot be trapped in this manner are trapped as a mud in filters throughout the system, and their concentration in boiler-feed condensate can be controlled and corrected before such condensate enters the boiler.

The grinder makes an atmospheric ice powder and is preferably installed as close as possible to the condenser in order to have the ice powder of the best quality at the condenser's location rather than using special devices to move the ice powder after grinding. In this case, the ice powder may be delivered from the grinder into the condenser due to the pressure difference between the sum of atmospheric pressure and pressure of the ice powder in the grinder, and a vacuum in the condenser.

By making ice powder from snow/ice, the grinder increases the contact surface between snow/ice and steam, facilitating heat transfer many hundreds of times over that of tube banks in indirect-contact condensers. This considerably diminishes the required size of the condenser, makes it possible to condense the turbine's exhaust steam entirely in the exhaust hood without installing a separate condenser, and increases the effectiveness of condensation. A layer of the ice powder in the grinder's bottom prevents air from entering into the zone of condensation.

A plurality of ice sprayers mix the ice powder with the exhaust and "dead" steam in the condenser. They also partially condense the steam in the last stages of the existing, already installed turbines where steam becomes supersaturated and wet, thus keeping the steam's density and speed in the last stages of the turbines below critical values when implementing the present invention for existing, already installed turbines, at an overload.

A vacuum exhaust pump/air ejector (usually, jet steam ejector or positive-displacement rotary vacuum pump) is standard equipment in steam plants. Its purpose is to evacuate air from a steam condenser. As employed in the present invention, the vacuum exhaust pump/air ejector preferably directs the cold air flow to a desired location (e.g. to steam-plant buildings, to the inside storage area, and to the bulk-load conveyor for air-conditioning, or to other locations having cooling needs). This can increase the overall economic efficiency of the system.

A condensate pump is also standard equipment in steam plants. Its purpose is to pump the condensate from a condenser well. As employed in the present invention, the condensate pump also operates as a circulator to provide icy condensate to the inside storage area.

Icy condensate is a good coolant for such cooling needs as refrigeration, air-conditioning, etc. It may also be used to facilitate snow/ice delivery from snow/ice collectors to the inside storage area through pipelines; for ice creation after freezing in snow/ice collectors; finds use for medical purposes and in food, chemical, pharmaceutical, etc. industries; may be exchanged for snow in cases where snow is needed for agricultural or water-supply needs (the system needs snow only to be melted in condenser, not in nature, so, it can return to nature the same mass of water in summer as the mass of snow taken in winter). These advantages increase the overall economical efficiency of the present invention.

The same pipelines, pumps, and valves may be used to deliver hot condensate from a steam plant to customers desiring heat for buildings or for other purposes. Such a heat supply is comfortable, is cheaper than conventional flame-generated heat supplies, reduces fire risks, and can use the same heat-transfer devices as those used for air-condition in summer.

A boiler-feed pump is also standard equipment in a steam plant. Its purpose is to feed boilers and plant heaters with a "soft" water at the warmest possible temperature. As employed by the present invention, this water is the return condensate or precipitation from the spillway basin. Using this supply of boiler-feed condensate eliminates the need for chemical treatment of boilers' and plant heaters' water, thereby reducing the cost of water treatment and heating, and maintenance problems.

The total volume of snow and ice in the inside storage area, at least one outside snow/ice collector, and received by direct snow/ice delivery to the condenser should preferably not be less than one-year's requirements for snow/ice in order to allow the system to be independent from any annual precipitation amount and weather conditions throughout the year, to secure a proper amount of the coolant in any conditions.

As one may see below in the Table entitled "Heat Balance for The Present Invention (1) and the Surface Condenser (2)", a modern system in accordance with the present invention should consume millions of pounds of snow/ice per hour. Therefore, it is rational if the snow/ice storage consists of the inside snow/ice/icy condensate storage area with, for example, sufficient volume for a weekly system need of snow/ice and outside snow/ice collectors with, for example, sufficient volume for a one-year (or more) system need of snow/ice. At existing power plants for inside storage areas, existing ponds, cooling towers, etc. may be used. For outside snow/ice collectors, abandoned mines, pits, or waterless canyons, ravines, etc., near the plant may be used.

The snow/ice collectors are preferably placed as close to the plant as possible. In such cases, the snow/ice from these collectors may be conveniently delivered to the inside storage area by means of pipelines. For example, the icy condensate from the inside storage area may be mixed with the snow/ice in a mixer near at least one outside snow/ice collector, the resulting mixture then flowing to the inside storage area via a storage pipeline and a storage pump. Before being stored in the inside storage area, the mixture is separated back into solids (snow/ice) and liquids (icy condensate) by a separator, with snow/ice flowing to an upper section of the inside storage and icy condensate flowing to a lower section of the inside storage area. During the mixture's transportation, the snow/ice in the mixture does not melt because the icy condensate and snow/ice have the same temperature. Such snow/ice delivery from the collectors to the steam plant during the course of the year is cheaper than by trucks, etc.

In one aspect of the invention, the system for direct-contact condensation with condensate, cold, and heat supplies in steam-turbine power plants, evaporators, other heat-and-mass transfer equipment having a condenser, comprises:

a steam turbine having a last stage and a steam-extraction heater (or an evaporator; or other heat-and-mass transfer equipment having a condenser);

a condenser receiving exhaust steam from the steam turbine (or the evaporator, or other heat-and-mass transfer equipment having a condenser), and a snow/atmospheric ice coolant from the system in the form of atmospheric ice powder in order to produce a vacuum and an icy condensate;

a boiler producing steam and hot condensate for delivery to the steam turbine (or the evaporator, or other heat-and-mass transfer equipment having a condenser) and to the system customers of heat from a feed-water delivered to the boiler from the system;

a deaerator excluding air from the feed-water before the boiler;

a condenser well being in fluid communication with the condenser in order to collect the icy condensate from the condenser;

at least one outside snow/ice collector accumulating and storing the snow/ice coolant in the form of snow, atmospheric ice, and condensate from precipitation from the vicinity, from snow/atmospheric ice delivered from cities, towns, roads, and other sources, and from condensate delivered from the system customers of cold and heat;

an inside storage area receiving the snow/ice coolant and icy condensate from the at least one outside snow/ice collector, condenser well, precipitation from the vicinity, direct snow/atmospheric ice delivery to the steam plant;

a spillway basin accumulating and storing a return condensate from the system customers of cold and heat, and precipitation from the vicinity of the spillway basin;

a boiler-feed pump in fluid communication with the spillway basin and/or the system customers of heat, in order to pump the condensate from the system customers of heat and/or from the spillway basin, to the boiler via the deaerator for steam and hot water production, and/or to the turbine's steam-extraction heater for hot water production (all of which allows for the elimination of water chemical treatment, a cost reduction for water supply and water heating and treatment, and a resulting increase of overall efficiency of the present invention);

a loader;

a bulk-load conveyor, the loader loading the snow/ice coolant from the inside storage area onto the bulk-load conveyor;

a grinder making the atmospheric ice powder from the snow/ice coolant;

a hard foreign matter separator, the bulk-load conveyor and direct snow/atmospheric ice delivery delivering the snow/ice coolant from the inside storage area and/or from the vicinity, cities, towns, roads, and other sources, in order to separate hard foreign matter from the snow/ice coolant delivered to the hard foreign matter separator, and inhibiting the hard foreign matter from entering the grinder, and the system after the grinder;

a plurality of ice sprayers mixing the exhaust steam with the atmospheric ice powder, receiving the atmospheric ice powder from the grinder and spraying the atmospheric ice powder into the exhaust steam in the condenser, and, in the case of existing, already installed turbines, additionally spraying the atmospheric ice powder into steam in the last stage of the steam turbine, at an overload, to thereby form a vacuum and icy condensate with undercritical steam apeeds;

a vacuum exhaust pump/air ejector evacuating cold air from the condenser well in order to support a vacuum inside the condenser, and to use the cold air for e.g. air-conditioning steam plant buildings and equipment;

a condensate pump in fluid communication with the condenser well and inside storage area in order to pump the icy condensate from the condenser well to the inside storage area; and filters separating a mud from condensate and precipitation after the condenser well, inside storage area, spillway basin, and system customers of cold and heat, for feed-water protection from impurities.

In other words, the inside storage area, outside snow/ice collectors, and spillway basin are provided in order to permit an effective all-the-year-round direct-contact condensation and a condensate/cold/heat supply for customers at any weather, at any precipitation levels. A hot, salt-free condensate may be generated by a steam plant and pumped to desired locations and customers for heating e.g. buildings, etc., and for other uses by taking hot condensate from heat-generating elements of the system, such as from the boiler or from the turbine's steam-extraction heater. This reduces the cost of heat for the customers, makes their heat supply fire-safe, allows use of the same heat-transfer devices for air-conditioning in summer and for heating in winter, increases the efficiency of the pipelines, pumps, valves, and heat-transfer devices, and contributes to the overall economic efficiency of the present invention. The loader and bulk-load conveyor are preferably provided in order to deliver the snow/ice coolant from the inside storage area to the hard foreign matter separator (separating hard foreign matter from the delivered snow/ice coolant and inhibiting the hard foreign matter from entering the grinder and the system after the grinder) and then to the grinder which makes the atmospheric ice powder from the snow/ice coolant in order to increase the contact surface between the ice and the equipment's exhaust steam and to thereby increase the heat-transfer rate at condensation. The plurality of ice sprayers are utilized in order to spray and mix the atmospheric ice powder (receiving this powder from the grinder) with the exhaust steam in the direct-contact condenser and in the last stages of existing, already installed turbines (where steam may become wet or supersaturated; this affords an appropriate density and undercritical flow velocity of the steam at the turbines' last stages, at an overload, thereby resulting in an effective operation of the turbine) to form a vacuum and icy condensate. The vacuum exhaust pump/air ejector is provided in order to evacuate cold air from the condenser (this air may be preferably used as a coolant e.g. for air-conditioning the steam-plant buildings, bulk-load conveyor and inside storage area), thereby affording effective vacuum during condensation of the turbine exhaust steam and increasing the overall economic efficiency of the plant. The condensate pump is provided in fluid communication with the condenser well and the inside storage area in order to pump the icy condensate from the condenser well to the inside storage area (which affords effective condensation in the condenser and an overall efficiency increase of the invention). Filters are provided in order to separate a mud from condensate and precipitation after the condenser well, inside storage area, spillway basin, and system customers, for the feed-water protection from impurities.

In another aspect of the invention, the system further comprises:

a mixer mixing the icy condensate with the snow/ice coolant near the at least one outside snow/ice collector,-for an economic snow/atmospheric ice delivery to the inside storage area, when the system needs an additional portion of snow/ice coolant inside the steam plant;

a snow/ice/icy condensate separator near the inside storage area, separating the snow/ice coolant from the icy condensate prior to storage of the snow/ice coolant in an upper, snow/ice section of the inside storage area, and the icy condensate in a lower, condensate section of the inside storage area;

a storage pump and storage pipeline with associated valves, connecting the mixer and the snow/ice/icy condensate separator.

In other words, it is a useful feature of the present invention that a pipeline with the pump and valves preferably delivers the mixture of the snow/ice coolant and the icy condensate from the at least one outside snow/ice collector to the snow/ice/icy condensate separator, where the mixture is again separated by the separator into the icy condensate and the snow/ice coolant prior to storage of the snow/ice coolant in an upper, snow/ice section of the inside storage area, and the icy condensate in a lower, condensate section of the inside storage area. Such delivery of snow/ice coolant affords an economic way of transporting the snow/ice from large snow/ice collectors to comparatively smaller inside storage areas, when the system needs an additional portion of the snow/ice coolant in the steam plant.

In yet another aspect of the invention, the system further comprises:

a first plurality of pipelines in fluid communication with the inside storage area and the system customers of cold and heat, the first plurality of pipelines also in fluid communication with the turbine's steam-extraction heater, boiler, at least one outside snow/ice collector, and mixer;

a first plurality of water pumps and an associated plurality of valves, filters, and water inlets connected to the first plurality of pipelines, in order to deliver the icy condensate from the inside storage area to the system customers of cold, at warm weathers, to the at least one outside snow/ice collector, and to the mixer, and to deliver hot condensate from the boiler or the turbine's steam-extraction heater to the system customers of heat, at cold weathers;

a second plurality of pipelines with associated water pumps, valves, filters in fluid communication with the system customers of cold and heat, spillway basin, and boiler-feed pump in order to deliver the return condensate from the system customers of cold and heat to the spillway basin and/or to the boiler-feed pump;

a third plurality of pipelines with associated water pumps, valves, filters, and water inlets in fluid communication with the spillway basin and system customers of condensate in order to deliver the condensate from the spillway basin to the system customers of condensate; the condensate also being removable by the system customers of condensate directly from the second plurality of pipelines;

a fourth plurality of pipelines with associated valves in fluid communication with the boiler-feed pump, deaerator, boiler, and turbine's steam-extraction heater in order to deliver the condensate from the boiler-feed pump to the boiler via the deaerator, and to the steam-extraction heater.

In other words, appropriate pipelines, pumps, and valves are provided to deliver the icy condensate from the inside storage area to the customers desiring cold water for air-conditioning, refrigeration, and other cooling needs, the same pipelines, pumps, and valves being used to deliver hot condensate from the boiler or turbine's steam-extraction heater to the customers desiring hot water to heat buildings and for other needs (both hot and cold water supplies affording the use of the same heat-transfer devices for air-condition in summer and heating in winter, an increase of the invention's overall efficiency). Pipelines, pumps, valves are also provided, as needed, for the return of condensate to a boiler-feed pump and to the spillway basin for possible subsequent delivery to customers desiring condensate (which affords a cost reduction for water supply and treatment and an increase of overall efficiency of the present invention).

The above-mentioned equipment makes the system permanently workable.

In yet another aspect of the invention, a total volume of the snow/ice coolant in the inside storage area, in the at least one outside snow/ice collector, and from a direct snow/atmospheric ice delivery to the system is not less than e.g. snow/ice amount necessary to run the system for one year.

This demand for the snow/ice coolant affords an effective usage of snow/atmospheric ice in the system, offers the system an independence from weather conditions and annual precipitation variances, and results in an increase of overall economic efficiency of the system, not to mention a useful application of snow removal from cities, towns, and roads, and a decrease of flood risk from springtime melting snow.

In yet another aspect of the invention, a height of the inside storage area is preferably divided by a floating partition e.g. with holes into an upper, snow/ice section and a lower, condensate section in order to decrease snow/ice losses due to absorption of the icy condensate into the snow/ice, and to drain from the snow/ice a water occured after partial melting of the snow/ice in the inside storage area. It is a useful feature of the present invention, because the floating partition increases the efficiency of the present invention.

In yet another aspect of the invention, during cold weather when temperatures outside the system fall below freezing, the floating partition is preferably removed e.g. by lowering and fixing near a bottom of the inside storage area, permitting an additional heat transfer between the icy condensate within the inside storage area and surroundings outside the system (e.g. by mixing the icy condensate with the snow/ice), thereby freezing the icy condensate within the inside storage area to ice for use in the future;

when the floating partition is removed, the icy condensate from the condenser well is directed in an upper, snow/ice section of the inside storage area to be frozen immediately.

This action affords an increase in the overall economic efficiency of the present invention, reduces the cost of the ice by cutting down expenses, and provides a reserve of the coolant for the system.

In yet another aspect of the invention, the equipment and storage areas (the turbine, turbine's steam-extraction heater, boiler, deaerator, condenser, condenser well, condensate pump, vacuum exhaust pump/air ejector, bulk-load conveyor, grinder, hard foreign matter separator, plurality of ice sprayers, at least one outside snow/ice collector, mixer, water and storage pumps, snow/ice/icy condensate separator, and inside storage area) and the pipelines (the first plurality of pipelines with associated valves and filters, second plurality of pipelines with associated valves, and the storage pipeline with associated valves) are thermoinsulated in order to reduce cold and heat losses from the system.

Thermoinsulation reduces cold/heat losses, prevents the snow/ice/icy powder/icy condensate from melting/heating/evaporating in warm weather, and prevents hot condensate from cooling in cold weather, affording an efficient use of snow/ice/icy and hot condensate in the system at any weather, thereby increasing the efficiency of plants employing the present invention.

In yet another aspect of the invention, the inside storage area and spillway basin are preferably interconnected via a pipeline and valve permitting a condensate exchange and accumulation of the snow, atmospheric ice, precipitation from the vicinity, icy and return condensate during the course of the year. This facilitates an uninterrupted direct-contact condensation in the condenser, and supplies of the coolant and "soft" water, resulting in an overall economic efficiency increase for the present invention.

In yet another aspect of the invention, excess condensate in the system is preferably taken e.g. from a top (the warmest) portion of the spillway basin via the water inlet and filter for delivery to the system customers of condensate for plant, industrial, service, domestic, and water-supply needs;

cold or warm condensate for these needs may be taken by the system customers of condensate directly from the second plurality of pipelines;

rest of the excess condensate is pumped from the inside storage area via the first plurality of pipelines with associated water pumps, water inlets, and valves to the at least one snow/ice collector to be frozen to ice during cold weather below freezing. This affords an effective use of the condensate in the system and by customers, of winter cold, secures a proper amount of the snow/ice coolant in any weather and delivery conditions, cuts down system's expenses, and increases the overall efficiency of the system and of the present invention.

In yet another aspect of the invention, the inside storage area, spillway basin, and at least one outside snow/ice collector are preferably covered with demountable thermoinsulated roofs in order to reduce useless cold and condensate losses from the system;

during cold weather when temperatures outside the system fall below freezing, these roofs may be demounted in order to use winter cold for freezing the condensate to ice, and to permit accumulation of the snow/ice for use in the future;

warm return condensate is directed to the boiler-feed pump directly from the second plurality of pipelines with associated valves, not from the spillway basin, when the roof is demounted from the spillway basin.

This action reduces the cost of maintaining a cold supply, provides a reserve of the snow/ice coolant for the system, and increases the overall economic efficiency of the present invention.

In yet another aspect of the invention, the turbine's steam-extraction heater may be a direct-contact heat exchanger, exchanging heat between steam extracted from the steam turbine and the condensate (which has the same chemical and physical properties as the extracted steam) delivered to water sprayers by the boiler-feed pump, thereby affording an increase in the effectiveness of the heat exchanger and in the overall efficiency of the present invention.

In yet another aspect of the invention, a method for direct-contact condensation with condensate, cold, and heat supplies in steam-turbine power plants, evaporators, and other heat-and-mass transfer equipment having a condenser, comprises:

condensing exhaust steam from the steam turbine or other heat-and-mass transfer equipment with a condenser, by spraying the snow/ice coolant in the form of atmospheric ice powder via the plurality of ice sprayers into the direct-contact condenser associated with the steam turbine (or other heat-and-mass transfer equipment having a condenser), and, in the case of existing, already installed steam turbines, into at least one last stage of the steam turbine, at an overload, in order to produce a vacuum and an icy condensate with under-critical steam speeds;

producing steam in the boiler for the steam turbine (or for evaporator, or for other heat-and-mass transfer equipment having a condenser) from a feed-water delivered from the system;

excluding air from the feed-water in the deaerator before the boiler;

collecting the icy condensate, created during condensation, from the condenser in a condenser well;

collecting and storing the snow/ice coolant in the form of snow, atmospheric ice, and condensate from precipitation from the vicinity, from from snow/atmospheric ice delivered from cities, towns, roads, and other sources, and from condensate delivered from the system customers of cold and heat, within the at least one outside snow/ice collector and inside storage area for use in the condenser during the course of the year;

pumping the icy condensate from the condenser well to the inside storage area via a filter, condensate pump and condenser pipeline;

loading via the loader the snow/ice coolant from the inside storage area onto a bulk-load conveyor;

making the atmospheric ice powder in the grinder from the snow/ice coolant;

providing a hard foreign matter separator;

conveying the snow/ice coolant to the hard foreign matter separator in order to separate hard foreign matter from the snow/ice coolant delivered to the hard foreign matter separator by the bulk-load conveyor and/or from the snow/ice coolant delivered e.g. from cities, towns, roads, and other sources, and inhibiting the hard foreign matter from entering the grinder and the system after the grinder; and evacuating cold air from the condenser well via a vacuum exhaust pump/air ejector in order to support a vacuum inside of the condenser and to use the cold air e.g. for air-conditioning the steam plant buildings, bulk-load conveyor, and inside storage area.

In yet another aspect of the invention is provided the following method steps:

providing, for an economic snow/ice delivery, a mixer near the at least one snow/ice collector;

pumping the icy condensate from the inside storage area to the mixer via the first plurality of pipelines, water inlets, water pumps, filters, and valves;

mixing the icy condensate in the mixer with the snow/ice coolant from the at least one outside snow/ice collector in order to make a snow/ice/icy condensate mixture;

providing the snow/ice/icy condensate separator near the inside storage area;

pumping the snow/ice/icy condensate mixture via the mixer, storage pump, storage pipeline with associated valves, from the at least one outside snow/ice collector to the snow/ice/icy condensate separator;

separating the snow/ice coolant from the icy condensate in the snow/ice/icy condensate separator prior to storage of the snow/ice coolant in an upper, snow/ice section of the inside storage area, and the icy condensate in a lower, condensate section of the inside storage area, when the system needs an additional portion of snow/ice coolant inside the steam plant.

In yet another aspect of the invention is provided the following method steps:

providing the spillway basin;

within the spillway basin, collecting and storing a return condensate which is pumped from the system customers of cold and heat via the second plurality of pipelines;

within the spillway basin, collecting and storing annual precipitation e.g. from the vicinity of the spillway basin;

pumping the return condensate and/or precipitation from the spillway basin, and/or the return condensate from the second plurality of pipelines to the deaerator, boiler, and water sprayers of the turbine's steam-extraction heater, via the boiler-feed pump;

pumping the icy condensate from the inside storage area to the system customers of cold via the first plurality of pipelines with associated water pumps, water inlets, valves, and filters, at warm weathers;

pumping hot condensate from the turbine's steam-extraction heater or from the boiler to the system customers of heat via the same first plurality of pipelines, water pumps, and valves, at cold weathers;

pumping condensate and/or precipitation from e.g. a top (the warmest) portion of the spillway basin to the system customers of condensate via the third plurality of pipelines with associated water pumps, valves, filters, and water inlets;

facilitating the removal of the condensate from the system by the customers of condensate e.g. directly from the second plurality of pipelines; and catching a mud from the condensate and precipitation by the filters after the condenser well, inside storage area, spillway basin, and system customers of cold and heat.

In yet another aspect of the invention, the inside storage area is dividable by e.g. floating partition e.g. with holes into an upper, snow/ice section and a lower, condensate section in order to decrease snow/ice coolant losses through absorption of the icy condensate into the snow/ice within the inside storage area, and to drain from the snow/ice a water occured e.g. after partial melting of the snow/ice within the inside storage area.

In yet another aspect of the invention is provided the following method steps of:

removing the floating partition by e.g. lowering and fixing the floatable partition near a bottom of the inside storage area, when outside temperatures fall below freezing, permitting an additional heat transfer between the icy condensate within the inside storage area and surrounding environment outside the system e.g. by mixing the icy condensate with the snow/ice, thereby accumulating ice within the inside storage area for use in the future;

when the floatable partition is removed, the icy condensate from the condenser well is directed to the upper, snow/ice section of the inside storage area to be frozen immediately.

In yet another aspect of the invention is provided the following method steps of:

providing a plurality of demountable thermoinsulated roofs, each of the thermoinsulated roofs covering the inside storage area, spillway basin, and at least one outside snow/ice collector in order to reduce cold and condensate losses;

demounting the plurality of thermoinsulated roofs from the inside storage area, spillway basin, and at least one outside snow/ice collector, when outside temperatures fall below freezing, thereby permitting accumulation of the snow/ice and winter cold for use in the future;

directing warm return condensate to the boiler-feed pump e.g. from the second plurality of pipelines with associated valves, not from the spillway basin, when the roof is demounted from the spillway basin, for use of the warmest feed-water for the boiler and turbine's steam-extraction heater.

Calculations indicate that the present invention would considerably reduce the pressure in the condenser (and hence the temperature and enthalpy of the condensation), by replacing a cooling water with ice/snow which has a temperature and enthalpy always lower than that of water.

Replacing a cooling water with ice/snow increases the enthalpy drop across the steam turbines (or other steam exhaust equipment), increases power output, and thereby increases overall efficiency of the plant. The use of icy/hot/warm condensate for cooling/heating/condensate needs also significantly increases the overall economic efficiency of the plant.

The elimination of the multitude of tubes and heat-transfer surfaces inside conventional surface condensers and connections between turbines and their condensers reduces the hydraulic resistance and pressure in condensers, lowers the cost of cooling, pump operation, and condenser maintenance (e.g. heat treatment of condenser tube banks is only necessary every 6 weeks), and reduces the capital cost of the condenser.

Major maintenance problems of surface condensers related to the fouling of tubes, corrosion, leakage of circulating water into treated water systems, circulating water supply and cooling, and extended downtime are largely eliminated.

The use of snow/ice from the vicinity, cities, towns, roads, etc. instead of water as a coolant reduces coolant cost and increases effectiveness of the equipment.

Since the amount of "soft" water in the system of the present invention is relatively large, chemical treatments of water in the present invention's system can be eliminated. Any risks associated with water losses from the cycle are greatly reduced due to the overabundance of water in the system.

For plants now utilizing ocean, sea, river, or lake water as circulating water, the capital costs and maintenance of the intake structures, sluices, screens, etc. designed to "clean up" water entering surface condensers are virtually eliminated by the present invention.

The present invention facilitates the maximum usage of existing equipment and technology. It is desirable to implement the present invention on both existing and new steam plants.

For steam-turbine power plants, evaporators, etc., utilizing condensers, the present invention may decrease (in comparison with other similar equipment on the market):

1. absolute pressure, temperature, and enthalpy of steam inside condensers,
2. electricity consumption and power for internal plant needs,
3. water consumption,
4. pump expenses,
5. sizes of condensers and auxiliary equipment,
6. expenses for circulating water treatment,
7. expenses for boilers' water chemical treatment,
8. environmental problems with circulating water and warming, and
9. internal deterioration of condensers.

As an example, compare main data and the performance of the present invention (1) with a current steam-turbine surface condenser (2) (Ormond Beach/Mandalay Generating Station, Ormond Beach, Calif., owned by Southern California Edison Company) with steam flow to the condenser being 3,450,000 LB/hr.

| | Item | | | |
|---|---|---|---|---|
| | (1) | | (2) | |
| | Fluids | | | |
| | Hot | Cold | Hot | Cold |
| 1 | 2 | 3 | 4 | 5 |
| Fluid | Steam | Ice powder | Steam | "Hard" water |

HEAT BALANCE FOR THE PRESENT INVENTION (1) AND THE SURFACE CONDENSER (2)

| | (1) | (2) |
|---|---|---|
| Condensation temperature, (degrees F.) | 32 | 105 |
| Heat of condensation, (BTU/lb) | 1,075.8 | 1,034.4 |
| Steam enthalpy, (BTU/lb) | 1,075.8 | 1,107.4 |
| Condensate enthalpy, (BTU/lb) | 0 | 73 |
| Steam parameters before the turbine: | | |
| flow, (lb/hr) | 3,450,000 | 3,450,000 |
| pressure, (lb/sq.in) | 3,515 | 3,515 |
| temperature, (degrees F.) | 1,000 | 1,000 |
| enthalpy, (BTU/lb) | 1,466.7 | 1,466.7 |
| Enthalpy difference in turbine, (BTU/lb) | 390.9 | 359.3 |
| Coolant parameters before the condensation: | | |
| temperature, (degrees F.) | 32 | 62 |
| enthalpy, (BTU/lb) | −144 | 30 |
| Coolant parameters after the condensation: | | |
| temperature, (degrees F.) | 32 | 91 |
| enthalpy, (BTU/lb) | 0 | 58.5 |
| flow, (lb/hr) | 29,250,000 | 120,000,000 |
| Coolant's temperature difference, (degrees F.) | 0 | 29 |
| Coolant's enthalpy difference, (BTU/lb) | 144 | 28.5 |

The electrical power increase (the present invention in comparison with the surface condenser as shown above) is directly proportional to the enthalpy difference in the turbine, so, it is equal to 390.9/359.3−1=0.088 (i.e. 8.8%).

The use of snow as a saleable article, precipitation and icy/hot/warm condensate for cooling/heating/condensate needs, the corresponding decrease of water-supply needs, the avoidance of some negative aspects of condenser operation, the practical use of snow from streets and roads, and the reduction of flood dangers and damages after the melting of snow in springtime additionally increase the overall economic efficiency of the present invention.

The present invention may be tested and implemented on the existing steam plants without dismantling installed equipment.

SUMMARY OF THE INVENTION

The above-described disadvantages of conventional condensers can be avoided by providing an improved system and method for direct-contact condensation for steam-turbine power plants, evaporators, and other heat-and-mass transfer equipment having a condenser while also providing potential customers with a supply of condensate, cold or hot water. This system and method utilizes direct contact of heat-and-mass transfer equipment (e.g. steam turbine) exhaust steam with an atmospheric ice powder at constant (32 degrees F.) temperature of condensation at any season and weather, which provides an effectively deeper vacuum without using a circulating "hard" water. Furthermore, this system and method makes snow a saleable article, prevents system fouling, avoids high thermal and hydraulic resistances in condensers, reduces system water supply needs, provides cold, heat, and condensate for the equipment and for customers, offers a decrease in the negative aspects of condensers' operation, and reduces the risk of flooding in an environment due to springtime melting of snow.

In one aspect of the present invention, the system comprises:

- a steam turbine having a last stage and a steam-extraction heater (or an evaporator; or other heat-and-mass transfer equipment having a condenser);
- a condenser receiving exhaust steam from the steam turbine, (or the evaporator, or the other heat-and-mass transfer equipment having a condenser), and a snow/atmospheric ice coolant in the form of atmospheric ice powder from the system in order to produce a vacuum and an icy condensate;
- a boiler producing steam and hot condensate for delivery to the steam turbine (or evaporator, or other heat-and-mass transfer equipment having a condenser), and to customers of heat from a feed-water delivered from the system;
- a deaerator excluding air from the feed-water before the boiler;
- a condenser well being in fluid communication with the condenser in order to collect the icy condensate from the condenser;
- at least one outside snow/ice collector accumulating and storing the snow/ice coolant in the form of snow, atmospheric ice, and condensate from precipitation from the vicinity, from snow/atmospheric ice delivered from cities, towns, roads, and other sources, and from condensate delivered from the system customers of cold and heat;
- an inside storage area receiving the snow/ice coolant and icy condensate from the at least one outside snow/ice collector, condenser well, precipitation from the vicinity, direct snow/atmospheric ice delivery to the steam plant;

a spillway basin accumulating and storing a return condensate from system customers of cold and heat, and precipitation from the vicinity of the spillway basin;

a boiler-feed pump in fluid communication with the spillway basin and/or the system customers of heat, in order to pump the condensate from the system customers of heat and/or from the spillway basin, to the boiler via the deaerator for steam production, and/or to the turbine's steam-extraction heater for hot water production (all of which allows for the elimination of water chemical treatment, a cost reduction for water supply and water heating and treatment, and a resulting increase of overall efficiency of the present invention);

a loader;

a bulk-load conveyor, the loader loading the snow/ice coolant from the inside storage area onto the bulk-load conveyor;

a grinder making the atmospheric ice powder from the snow/ice coolant;

a hard foreign matter separator, the bulk-load conveyor and direct snow/atmospheric ice delivery delivering the snow/ice coolant from the inside storage area and/or from the vicinity, cities, towns, roads, and other sources, in order to separate hard foreign matter from the snow/ice coolant delivered to the hard foreign matter separator, and inhibiting the hard foreign matter from entering the grinder, and the system after the grinder;

a plurality of ice sprayers mixing the exhaust steam with the atmospheric ice powder, receiving the atmospheric ice powder from the grinder and spraying the atmospheric ice powder into the exhaust steam in the condenser, and, in the case of existing, already installed turbines, additionally spraying the atmospheric ice powder into steam in the last stage of steam turbine, at an overload, to thereby form a vacuum and icy condensate with undercritical steam speeds;

a vacuum exhaust pump/air ejector evacuating cold air from the condenser well in order to support a vacuum inside the condenser, and to use the cold air for e.g. air-conditioning steam plant buildings and equipment;

a condensate pump in fluid communication with the condenser well and the inside storage area in order to pump the icy condensate from the condenser well to the inside storage area; and filters separating a mud from the condensate and precipitation after the condenser well, inside storage area, spillway basin, system customers of cold and heat, in order to protect feed-water from impurities.

In other words, the inside storage area, outside snow/ice collectors, spillway basin are provided in order to permit an effective all-the-year-round direct-contact condensation and a condensate/cold/heat supply for the system customers at any weather and at any precipitation levels.

The loader and bulk-load conveyor are preferably provided in order to deliver the snow/ice coolant from the inside storage area to the hard foreign matter separator together with a direct snow/ice delivery from cities, towns, roads, and other sources. The hard foreign matter separator separates hard foreign matter from the delivered snow/atmospheric ice coolant and inhibits the hard foreign matter from entering the grinder and the system after the grinder.

The grinder makes the atmospheric ice powder from the snow/atmospheric ice coolant in order to increase the contact surface between the ice and the equipment's exhaust steam and to thereby increase the heat-transfer rate at condensation.

The plurality of ice sprayers are utilized in order to spray and mix the atmospheric ice powder (receiving this powder from the grinder) with the exhaust steam in the direct-contact condenser and in the last stages of existing, already installed turbines (where steam may become wet or supersaturated; this affords an appropriate density and undercritical flow velocity of the steam at the turbines' last stages, at an overload, thereby resulting in an effective operation of the turbine) to form a vacuum and icy condensate.

The vacuum exhaust pump/air ejector is provided in order to evacuate cold air from the condenser (this air may be preferably used as a coolant e.g. for air-conditioning the steam-plant buildings, bulk-load conveyor and inside storage), thereby affording effective vacuum during condensation of the turbine exhaust steam and increasing the overall economic efficiency of the plant.

The condensate pump is provided in fluid communication with the condenser well and the inside storage area in order to pump the icy condensate from the condenser well to the inside storage area (which affords effective condensation in the condenser and an overall efficiency increase of the invention).

Hot, salt-free condensate may be generated by the steam plant and pumped to desired locations and customers for heating (e.g. buildings, etc.), and for other uses by taking hot condensate from heat-generating elements of the steam plant, such as from the boiler or from the turbine's steam-extraction heater. This allows use of the same heat-transfer devices for air-conditioning in summer and for heating in winter, reduces the cost of heat for the customers, makes their heat supply fire-safe, increases the efficiency of the pipelines, pumps, valves,and heat-transfer devices, and contributes to the overall economic efficiency of the present invention.

Filters are provided in order to separate a mud from condensate and precipitation after the condenser well, inside storage area, spillway basin, system customers of cold and heat, for the feed-water protection from impurities.

In another aspect of the invention, the system further comprises:

a mixer mixing the icy condensate with the snow/ice coolant near the at least one outside snow/ice collector,-for an economic snow/atmospheric ice delivery to the inside storage area, when the system needs an additional portion of the snow/ice coolant inside the steam plant;

a snow/ice/icy condensate separator near the inside storage area, separating the snow/ice coolant from the icy condensate prior to storage of the snow/ice coolant in an upper, snow/ice section of the inside storage area, and the icy condensate in a lower, condensate section of the inside storage area;

a storage pump and storage pipeline with associated valves, connecting the mixer and the snow/ice/icy condensate separator.

In other words, it is a useful feature of the present invention that a pipeline with the pump and valves preferably deliver the mixture of the snow/ice coolant and the icy condensate from the at least one outside snow/ice collector to the snow/ice/icy condensate separator, where the mixture is again separated by the separator into the icy condensate and the snow/ice coolant prior to storage of the snow/ice coolant in an upper, snow/ice section of the inside storage area, and the icy condensate in a lower, condensate section of the inside storage area, when the system needs an additional portion of the snow/ice coolant inside the steam plant. Such a delivery of the snow/ice coolant affords an economic way of transporting the snow/ice from large outside snow/ice collectors to comparatively smaller inside storage areas.

In yet another aspect of the invention, the system further comprises:

a first plurality of pipelines in fluid communication with the inside storage area and the system customers of cold and heat, the first plurality of pipelines also in fluid communication with the turbine's steam-extraction heater, boiler, at least one outside snow/ice collector, and mixer;

a first plurality of water pumps and an associated plurality of valves, filters, and water inlets connected to the first plurality of pipelines, in order to deliver the icy condensate from the inside storage area to the system customers of cold, at warm weathers, to the at least one outside snow/ice collector, and to the mixer, and to deliver hot condensate from the boiler or the turbine's steam-extraction heater to the system customers of heat, at cold weathers;

a second plurality of pipelines with associated water pumps, valves, filters in fluid communication with the system customers of cold and heat, spillway basin, and boiler-feed pump in order to deliver the return condensate from the system customers of cold and heat to the spillway basin and/or to the boiler-feed pump;

a third plurality of pipelines with associated water pumps, valves, filters, and water inlets in fluid communication with the spillway basin and system customers of condensate in order to deliver condensate from the spillway basin to the system customers of condensate; the condensate also being removable by the system customers of condensate directly from the second plurality of pipelines;

a fourth plurality of pipelines with associated valves in fluid communication with the boiler-feed pump, deaerator, boiler, and turbine's steam-extraction heater in order to deliver condensate from the boiler-feed pump to the boiler via the deaerator, and to the turbine's steam-extraction heater.

In other words, appropriate pipelines, pumps, and valves are provided to deliver the icy condensate from the inside storage area to the customers desiring cold water for air-conditioning, refrigeration, and other cooling needs, the same pipelines, pumps, and valves being used to deliver hot condensate from the boiler or turbine's steam-extraction heater to the customers desiring hot water to heat buildings and for other needs (both cold and hot water supplies affording an increase of the invention's overall efficiency). Pipelines, pumps, and valves are also provided, as needed, for the return of condensate to a boiler-feed pump and to the spillway basin for possible subsequent delivery to customers desiring condensate (which affords a cost reduction for water supply and treatment and an increase of overall efficiency of the present invention).

The above-mentioned equipment makes the system permanently workable.

In yet another aspect of the invention, a total volume of the snow/ice coolant in the inside storage area, in the at least one outside snow/ice collector, and from a direct snow/atmospheric ice delivery to the system is not less than e.g. snow/ice amount necessary to run the system for one year.

This demand for the snow/ice coolant affords an effective usage of snow/atmospheric ice in the system, offers the system an independence from weather conditions and annual precipitation variances, and results in an increase of overall economic efficiency of the system, not to mention an useful application of snow removal from cities, towns, roads, and otqer sources, and a decrease of flood risk from springtime melting snow.

In yet another aspect of the invention, a height of the inside storage area is preferably divided by a floating partition e.g. with holes into an upper, snow/ice section and a lower, condensate section in order to decrease snow/ice losses due to absorption of the icy condensate into the snow/ice, and to drain from the snow/ice a water occured after partial melting of the snow/ice in the inside storage area. It is an useful feature of the present invention, because the floating partition increases the efficiency of the present invention.

In yet another aspect of the invention, during a cold weather when temperatures outside the system fall below freezing, the floating partition is preferably removed e.g. by lowering and fixing near a bottom of the inside storage area, permitting an additional heat transfer between the icy condensate within the inside storage area and surroundings outside the system (e.g. by mixing the icy condensate with the snow/ice), thereby freezing icy condensate within the inside storage area to ice for use in the future;

when the floating partition is removed, the icy condensate from the condenser well is directed in an upper, snow/ice section of the inside storage area to be frozen immediately.

This action affords an increase in the overall economic efficiency of the present invention, reduces the cost of the ice by cutting down expenses, and provides a reserve of the coolant for the system.

In yet another aspect of the invention, the equipment and storage areas (the turbine, turbine's steam-extraction heater, boiler, deaerator, condenser, condenser well, condensate pump, vacuum exhaust pump/air ejector, bulk-load conveyor, grinder, hard foreign matter separator, plurality of ice sprayers, at least one outside snow/ice collector, mixer, water and storage pumps, snow/ice/icy condensate separator, and inside storage area) and the pipelines (the first plurality of pipelines with associated valves and filters, second plurality of pipelines with associated valves, storage pipeline with associated valves) are thermoinsulated in order to reduce cold and heat losses from the system.

This prevents the snow/ice/icy powder/icy condensate from melting/heating/evaporating in warm weather, and prevents hot condensate from cooling in cold weather, affording an efficient use of snow/ice/icy and hot condensate in the system at any weather, thereby increasing the efficiency of plants employing the present invention.

In yet another aspect of the invention, the inside storage area and spillway basin are preferably interconnected via a pipeline and valve permitting a condensate exchange and accumulation of the snow, atmospheric ice, precipitation from the vicinity, icy and return condensate during the course of the year. This facilitates an uninterrupted direct-contact condensation in the condenser, supplies of the coolant and "soft" water, resulting in an overall economic efficiency increase for the present invention.

In yet another aspect of the invention, excess condensate in the system is preferably taken, for example, from a top (the warmest) portion of the spillway basin via the water inlet and filter for delivery to the system customers of condensate for plant, industrial, service, domestic, and water-supply needs;

a cold or warm condensate for these needs may be taken by the system customers of condensate directly from the second plurality of pipelines;

the rest of excess condensate is pumped from the inside storage area via the first plurality of pipelines with associated water pumps, water inlets, and valves to the at least one outside snow/ice collector to be frozen to ice during cold weather below freezing for an effective use of winter cold and for securing a proper amount of the snow/ice coolant in any weather and delivery conditions. This cuts down on system expenses, increases the overall efficiency of the system and of the present invention.

In yet another aspect of the invention, the inside storage area, spillway basin, and at least one outside snow/ice collector are preferably covered with demountable thermo-insulated roofs in order to reduce cold and condensate losses from the system;

during cold weather, when temperatures outside the system fall below freezing, these roofs are preferably demounted in order to use a winter cold for freezing the condensate to ice, and to permit accumulation of the snow/ice coolant for use in the future. This action reduces the cost of maintaining a cold supply, provides a reserve of the coolant in the system, increases the overall economic efficiency of the present invention;

warm return condensate is directed to the boiler-feed pump from the second plurality of pipelines with associated valves, not from the spillway basin, when the roof is demounted from the spillway basin. This allows use of the warmest feed-water for the boiler and the turbine's steam-extraction heater.

In yet another aspect of the invention, the turbine's steam-extraction heater is a direct-contact heat exchanger, exchanging heat between steam extracted from the steam turbine and the condensate (which has the same chemical and physical properties as the extracted steam) delivered to water sprayers by the boiler-feed pump, thereby affording an increase in the effectiveness of the heat exchanger and in the overall efficiency of the present invention.

In yet another aspect of the invention, a method for direct-contact condensation with condensate, cold, and heat supplies in steam-turbine power plants, evaporators, and other heat-and-mass transfer equipment having a condenser, comprises the steps of:

condensing exhaust steam from the steam turbine or other heat-and-mass transfer equipment having a condenser, by spraying the snow/ice coolant in the form of atmospheric ice powder via a plurality of ice sprayers into the direct-contact condenser associated with steam turbine or other heat-and-mass transfer equipment having a condenser, and, in the case of existing, already installed steam turbines, into at least one last stage of the steam turbine, at an overload, in order to produce a vacuum and an icy condensate with undercritical steam speeds;

producing steam in a boiler for a steam turbine, or for evaporator, or for other heat-and-mass transfer equipment having a condenser, from a feed-water delivered from the system;

excluding air from the feed-water in the deaerator before the boiler;

collecting the icy condensate, created during condensation, from the condenser in a condenser well;

collecting and storing the snow/ice coolant in the form of snow, atmospheric ice, and condensate from precipitation from the vicinity, from snow/atmospheric ice delivered from cities, towns, roads, and other sources, and from condensate delivered from the system customers of cold and heat, within the at least one outside snow/ice collector and inside storage area for use in the condenser during the course of the year;

pumping the icy condensate from the condenser well to the inside storage area via a filter, condensate pump and condenser pipeline;

loading via a loader the snow/ice coolant from the inside storage area onto a bulk-load conveyor;

making the atmospheric ice powder in a grinder from the snow/ice coolant;

providing a hard foreign matter separator;

conveying the snow/ice coolant to the hard foreign matter separator in order to separate hard foreign matter from the snow/ice delivered to the hard foreign matter separator by the bulk-load conveyor and/or from the snow/ice coolant delivered e.g. from cities, towns, roads, and other sources, and inhibiting the hard foreign matter from entering the grinder and the system after the grinder; and evacuating cold air from the condenser well via a vacuum exhaust pump/air ejector in order to support a vacuum inside of the condenser and to use the cold air e.g. for air-conditioning the steam plant buildings, bulk-load conveyor, and inside storage area.

In yet another aspect of the invention is provided the following steps of:

providing, for an economic snow/ice delivery, a mixer near the at least one outside snow/ice collector;

pumping the icy condensate from the inside storage area to the mixer via a first plurality of pipelines, water inlets, water pumps, filters, and valves;

mixing the icy condensate in the mixer with the snow/ice coolant from the at least one outside snow/ice collector in order to make a snow/ice/icy condensate mixture;

providing a snow/ice/icy condensate separator near the inside storage area;

pumping the snow/ice/icy condensate mixture via the mixer, storage pump, storage pipeline with associated valves, from the at least one outside snow/ice collector to the snow/ice/icy condensate separator;

separating the snow/ice coolant from the icy condensate in the snow/ice/icy condensate separator prior to storage of the snow/ice coolant in an upper, snow/ice section of the inside storage area, and the icy condensate in a lower, condensate section of the inside storage area, when the system needs an additional portion of the snow/ice coolant inside the steam plant.

In yet aspect of the invention is provided the following steps of:

providing a spillway basin;

within the spillway basin, collecting and storing a return condensate which is pumped from the system customers of cold and heat via the second plurality of pipelines;

within the spillway basin, collecting and storing annual precipitation e.g. from the vicinity of the spillway basin;

pumping the return condensate and/or precipitation from the spillway basin, and/or the return condensate from the second plurality of pipelines to the deaerator, boiler, and water sprayers of the turbine's steam-extraction heater, via the boiler-feed pump;

pumping the icy condensate from the inside storage area to system customers of cold via the first plurality of pipelines with associated water pumps, water inlets, valves, and filters, at warm weathers;

pumping hot condensate from the turbine's steam-extraction heater or from the boiler to system customers of heat via the same first plurality of pipelines, water pumps, and valves, at cold weathers;

pumping condensate and/or precipitation from the spillway basin to system customers of condensate via the third plurality of pipelines with associated water pumps, valves, filters, and water inlets;

facilitating the removal of the condensate from the system by the customers of condensate e.g. directly from the second plurality of pipelines; and catching a mud from the condensate and precipitation by the filters after the condenser well, inside storage area, spillway basin, and system customers of cold and heat, for feed-water protection from impurities.

In yet another aspect of the invention the inside storage area is dividable by e.g. floating partition e.g. with holes into an upper, snow/ice section and a lower, condensate section in order to decrease snow/ice coolant losses through absorption of the icy condensate into the snow/ice within the inside storage area, and to drain from the snow/ice a water occured e.g. after partial melting of the snow/ice within the inside storage area.

In yet another aspect of the invention is provided the following step of:

removing the floating partition e.g. by lowering and fixing the floatable partition near a bottom of the inside storage area, when outside temperatures fall below freezing, permitting an additional heat transfer between the icy condensate within the inside storage area and surrounding environment outside the system e.g. by mixing the icy condensate with the snow/ice, thereby freezing the condensate and accumulating ice within the inside storage area for use in the future;

when the floatable partition is removed, the icy condensate from the condenser well is directed to the upper, snow/ice section of the inside storage area to be frozen immediately.

In yet another aspect of the invention is provided the following steps of:

providing a plurality of demountable thermoinsulated roofs, each of the thermoinsulated roofs covering the inside storage area, spillway basin, and at least one outside snow/ice collector in order to reduce cold and condensate losses;

demounting the plurality of thermoinsulated roofs from the inside storage area, spillway basin, and at least one outside snow/ice collector, when outside temperatures fall below freezing, thereby permitting accumulation of the snow/ice and winter cold (in the ice from condensate) for use in the future;

directing warm return condensate to the boiler-feed pump e.g. from the second plurality of pipelines with associated valves, not from the spillway basin, when the roof is demounted from the spillway basin, for use of the warmest feed-water for the boiler and the turbine's steam-exraction heater.

Other objects, advantages and features of the present invention will become readily apparent to persons versed in the art from the following detailed description of the preferred embodiments taken in connection with the accompanying drawings.

BRIEF DESCRIPTION OF THE DRAWINGS

In order that the invention may be more fully comprehended, it will now be described, by way of example, with reference to the accompanying drawings.

Like reference numerals refer to similar details throughout the drawings and descriptions.

DESCRIPTION OF THE PREFERRED EMBODIMENT

Figure 1:
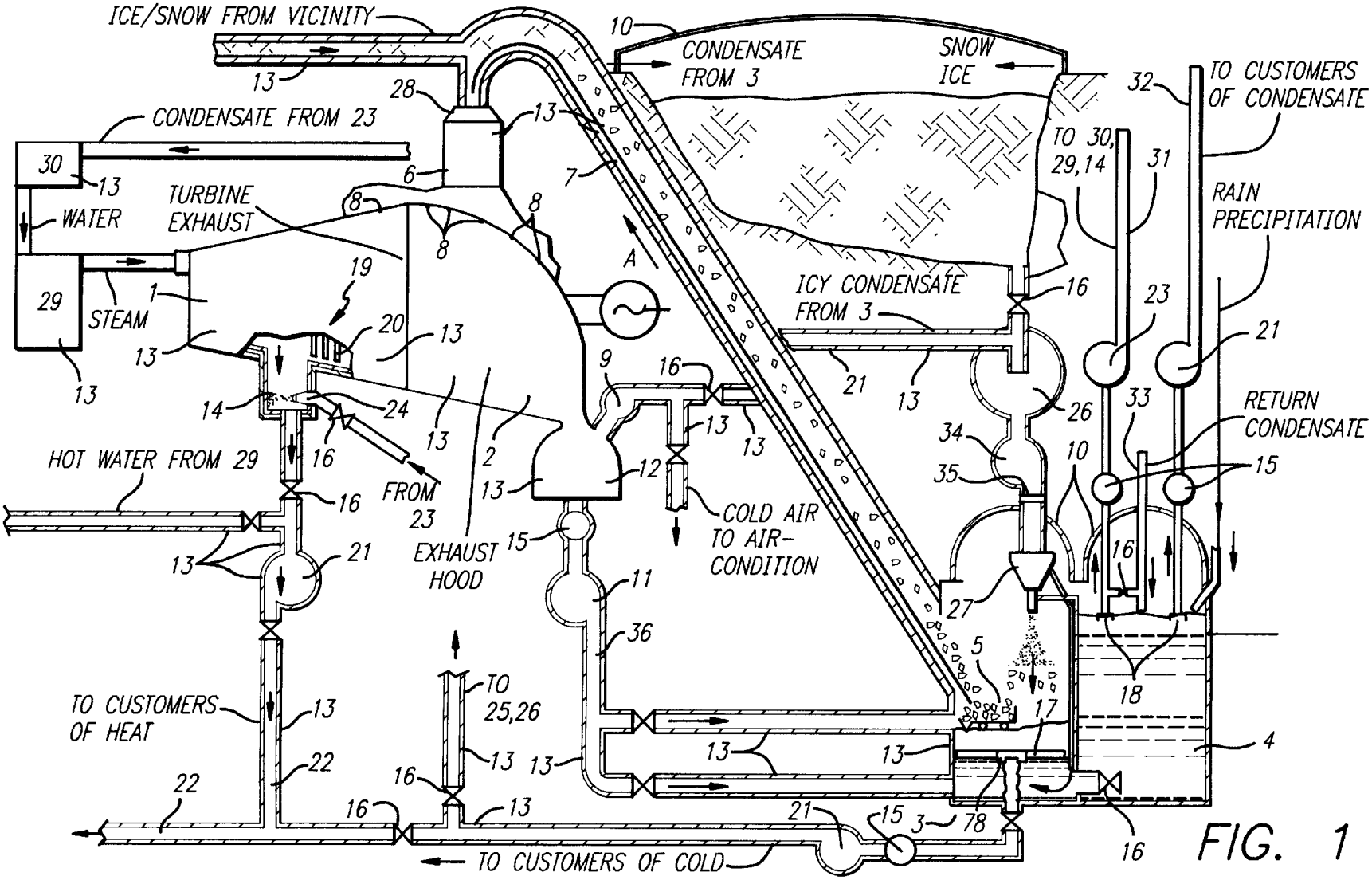
FIG. 1 is a schematic representation of the system of the present invention.

Before explaining the invention in detail, it is to be understood that the invention is not limited in its application to the details of construction and arrangement of parts illustrated in the drawings, since the present invention is capable of use in other embodiments and of being practiced or carried out in various ways. It is also to be understood that phraseology or terminology employed is for the purpose of description only and not of limitation.

Figure 2:
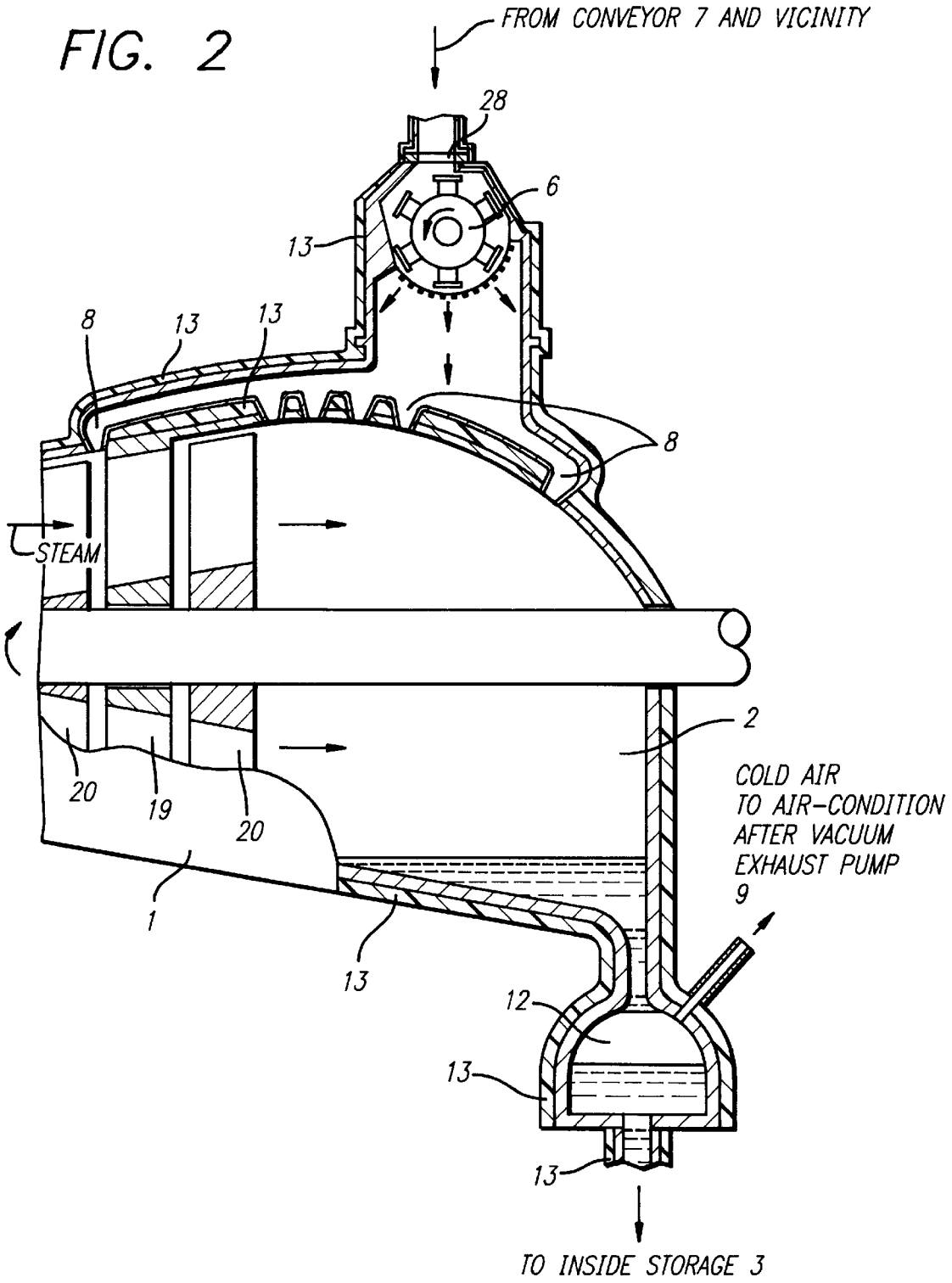
FIG. 2 is a detail of a sectional view of FIG. 1 on an enlarged scale.

Referring to FIGS. 1 and 2, in which like parts are similarly designated, there is shown a direct-contact condenser 2 for the condensation of exhausted steam from a steam turbine 1 by means of direct contact of the steam with an atmospheric ice powder.

An inside storage area 3 accumulates and stores snow, atmospheric ice, and icy condensate from a condenser well 12 via a filter 15, condensate pump 11, condenser pipeline 36, and from at least one outside snow/ice collector 25. The spillway basin 4 accumulates and stores a return condensate from customers of cold and heat and annual precipitation collected in the vicinity of the basin 4.

When outside temperatures fall below freezing, the condensate in at least one outside snow/ice collector 25, inside storage area 3, and spillway basin 4 may be frozen to ice for use in the future.

A loader 5 and a thermoinsulated bulk-load conveyor 7 deliver (in the direction indicated by arrow A) the snow/ice coolant from inside storage area 3 to a hard foreign matter separator 28 which separates foreign matter from snow/ice coolant, thereby inhibiting such foreign matter from entering grinder 6 and the system after grinder 6. The snow/ice coolant may also be delivered to separator 28 from direct (not from inside storage area 3) delivery from the vicinity, cities, towns, roads, and other sources. From the separator 28 the snow/ice coolant goes to a grinder 6 which prepares the atmospheric ice powder. As it is shown more fully in FIG. 2, plurality of ice sprayers 8 mix the atmospheric ice powder from the grinder 6 with exhaust steam from the steam turbine 1 in condenser (exhaust hood) 2 and before the last stage of an existing, already installed turbine stator 19 in order to create a vacuum, icy condensate, and to prevent supercritical speeds of the steam at the last stage of turbine rotor 20 of existing, already installed steam turbines 1, at an overload.

A vacuum exhaust pump/air ejector 9 evacuates cold air from condenser 2. Preferably, this air is used as a coolant e.g. for air-conditioning of the steam-plant buildings, bulk-load conveyor 7, inside storage area 3, and for other uses.

The filters 15 catch a mud from condensate and precipitation after condenser well 12, inside storage area 3, spillway basin 4, and system customers of cold and heat.

A first plurality of pipelines 22, water pumps 21, and valves 16 deliver the icy condensate from inside storage area 3 to customers desiring cold (cold water) for air-conditioning, refrigeration, and other cooling needs, at warm weathers. The same pipelines 22, water pumps 21, and valves 16 are also used to deliver hot condensate from boiler 29 or turbine's steam-extraction heater 14 to customers desiring heat (hot condensate) for heating buildings and for other hot water uses, at cold weathers. Return condensate is pumped via a fourth plurality of pipelines 31 and valves 16 from a second plurality of pipelines 33 or from spillway basin 4 by boiler-feed pump 23 to boiler 29 through deaerator 30 for steam and hot condensate production and to water sprayers 24 of turbine's steam-extraction heater 14 for heat (hot condensate) production.

Icy condensate is also pumped from inside storage area 3 via water inlet 18, pipelines 22 by water pump 21 to at least one outside snow/ice collector 25 and to mixer 26. The mixer 26 preferably mixes the icy condensate with the snow/ice coolant from outside snow/ice collector 25. Mixing the snow/ice coolant with the icy condensate in this manner permits efficient and economic delivery of the snow/ice coolant in mixture with icy condensate to inside storage area 3 via storage pump 34 and storage pipeline 35. Upon entering inside storage area 3, the icy condensate and the snow/ice coolant are preferably separated from their mixture into solids (snow/ice) and liquids (condensate) by a separator 27.

The total volume of the snow/ice coolant in inside storage area 3, at least one outside snow/ice collector 25, and from direct snow/atmospheric ice delivery to condenser 2 is not less than the system's one-year snow/ice coolant requirements, thereby assuring independence from weather and annual precipitation fluctuations. As previously indicated, naturally occurring geographic formations can be used as snow/ice collectors 25.

The height of inside storage area 3 is preferably divided by a floatable partition 17 e.g. with holes in order to prevent useless snow/ice coolant losses due to absorption of the icy condensate into the snow/ice, and to drain from the snow/ice coolant a water occured after partial melting of snow/ice in the inside storage area 3 (which may diminish the efficient use of the snow/ice coolant). The avoidance of losses in this manner increases the efficiency of the present invention.

When the outside temperatures fall below the freezing point, floatable partition 17 is preferably removed (e.g. lowered and fixed near the bottom of inside storage area 3), facilitating an additional heat transfer in inside storage area 3 between the icy condensate and surroundings e.g. by mixing the icy condensate with snow/ice in order to freeze the icy condensate to ice, to accumulate cold for use in the future. When partition 17 is removed, the icy condensate from condenser well 12 is directed to an upper, snow/ice section of inside storage area 3 in order to be frozen immediately.

The equipment (steam turbine 1, condenser 2, inside storage area 3, grinder 6, bulk-load conveyor 7, plurality of ice sprayers 8, vacuum exhaust pump/air ejector 9, condensate pump 11, condenser well 12, steam-extraction heater 14, filters 15, valves 16, water pumps 21, boiler-feed pump 23, outside snow/ice collector 25, mixer 26, separator 27, hard foreign matter separator 28, boiler 29, deaerator 30, and storage pump 34), and pipelines 22, 35, 36 are preferably protected from heat or cold losses by thermoinsulation 13, thereby preventing the snow/ice and icy condensate from useless melting and warming and preventing hot condensate from useless cooling. Such protection offers an effective use of the snow/ice coolant and condensate at any weather.

Inside storage area 3 and spillway basin 4 are preferably interconnected via valve 16 to permit condensate exchange; both being supplied with snow/ice, precipitation, icy and return condensate during the course of the year in order to allow uninterrupted direct-contact condensation and the system operation.

Excess condensate is taken from the system (preferably from a top, the warmest part of spillway basin 4), via water inlets 18, filters 15, and a third plurality of pipelines 32 for plant, industrial, service, domestic, or water-supply needs of customers desiring condensate, making an economically efficient use of this condensate. The cold or warm condensate for these needs may be taken by the customers directly from the second plurality of pipelines 33.

The rest of excess condensate is pumped to at least one snow/ice collector 25 to be frozen to ice during cold weather below freezing, for effective use of winter cold and for securing a proper amount of the coolant at any weather and delivery conditions, thereby cutting down system expenses and increasing the overall efficiency of the system.

Inside storage area 3, spillway basin 4, and at least one snow/ice collector 25 are preferably covered with thermo-insulated demountable roofs 10 in order to decrease useless cold and condensate losses.

During cold weather (when the outside temperatures fall below the freezing point), roofs 10 are demounted, and inside storage area 3, spillway basin 4, and at least one snow/ice collector 25 are opened to accumulate snow, atmospheric ice, and cold (by freezing condensate) for use in the future, at other weathers. This helps to ensure uninterrupted direct-contact condensation in the system, to provide a reserve of the coolant, and to increase the overall economic efficiency of the invention, while offering a use for winter cold and snow removed from cities, towns, roads, and other sources in the future, and decreasing the risk of flooding after melting of snow in springtime. When roof 10 is demounted from spillway basin 4, warm return condensate is directed to boiler-feed pump 23 from the second plurality of pipelines 33 with associated valves 16, not from spillway basin 4, in order to use the warmest feed-water for boiler 29 and steam-extraction heater 14.

Hot condensate may be used to heat buildings and for other heat (hot water) uses, at cold weathers. To accomplish this, hot condensate is taken from boiler 29 or from turbine's steam-extraction heater 14 and delivered to customers desiring hot water via pipelines 22, water pumps 21 and valves 16. This source of heating may be cheaper and less dangerous than a flame-generated heating, and allows use of the same heat-transfer devices for summer air-conditioning and winter heating.

Turbine's steam-extraction heater 14 is here a direct-contact heat exchanger between the steam extracted from turbine 1 and the condensate sprayed by means of water sprayers 24. A direct-contact heat exchanger is used again here in order to increase the effectiveness of heat exchanger 14 and of the present invention.

Figure 3:
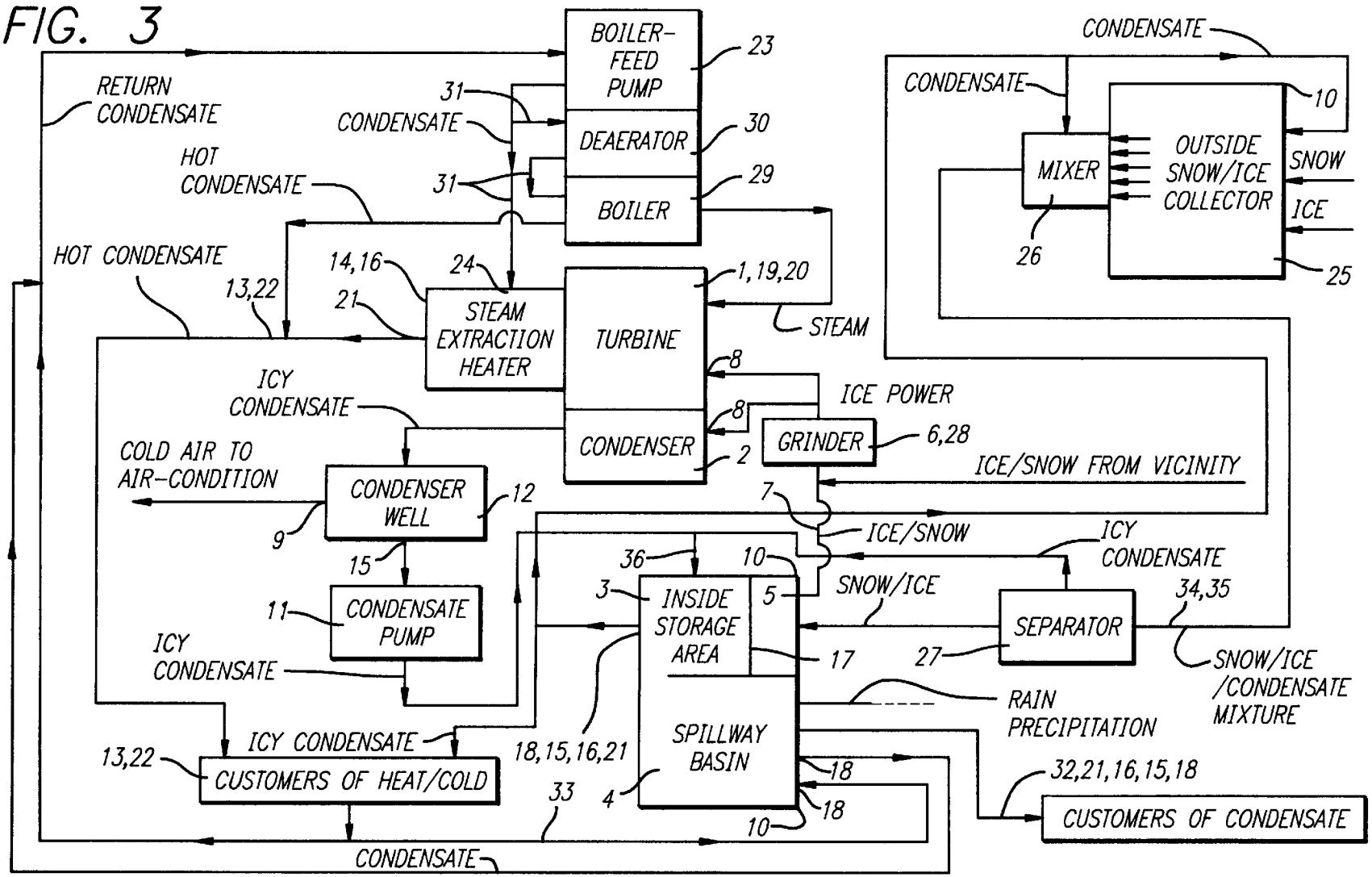
FIG. 3 is a flowchart of the method of the present invention.

Referring to FIG. 3, in which like parts are designated similarly to FIGS. 1 and 2, there are shown flows of steam, snow/ice, atmospheric ice powder, icy, cold, hot, warm, and return condensate, snow/ice/icy condensate mixture, precipitation, and cold air in the method for direct-contact condensation with condensate, cold, and heat supplies in steam-turbine power plants, evaporators, and other heat-and-mass transfer equipment having a condenser.

Exhaust steam from steam turbine 1 (or other heat-and-mass transfer equipment having a condenser) is condensed by spraying this ice powder via plurality of ice sprayers 8 into direct-contact condenser (exhaust hood) 2 associated with steam turbine 1 (or other heat-and-mass transfer equipment having a condenser), and, in the case of existing, already installed turbines, into at least one last stage of turbine 1, at an overload, in order to produce a vacuum and an icy condensate with undercritical steam speeds.

Snow, atmospheric ice and icy condensate are collected and stored within at least one outside snow/ice collector 25 and inside storage area 3. From inside storage area 3, the snow/ice coolant is preferably loaded via loader 5 to bulk-load conveyor 7 which conveys the snow/ice coolant to hard foreign matter separator 28 which separates hard foreign matter from the snow/ice delivered by bulk-load conveyor 7 and/or delivered from cities, towns, roads, and other sources, and inhibits such foreign matter from entering grinder 6 and the system after grinder 6.

Grinder 6 grinds the snow/ice coolant into an atmospheric ice powder.

Icy condensate, created during the condensation, is collected in condenser well 12 and pumped from condenser well 12 to inside storage area 3 via condensate pump 11 and condenser pipeline 36.

Boiler-feed pump 23 pumps return condensate and/or rain precipitation from spillway basin 4, and/or from the second plurality of pipelines 33, to deaerator 30, boiler 29, and water sprayers 24 of steam-extraction heater 14.

Cold air is evacuated from condenser 2 preferably from condenser well 12 via vacuum exhaust pump/air ejector 9 for use e.g. in air-conditioning preferably plant buildings, bulk-load conveyor 7, and inside storage area 3.

For economic reasons of delivery, the snow/ice coolant is preferably pumped in a mixture with icy condensate from collector 25 via mixer 26, storage pump 34, storage pipeline 35 with associated valves 16, snow/ice/condensate separator 27, to inside storage area 3, when the system needs an additional portion of snow/ice coolant in a steam plant.

At least one outside snow/ice collector 25 is preferably connected to inside storage area 3, for economic snow/ice coolant delivery, via mixer 26, storage pump 34, and storage pipeline 35; icy condensate is pumped preferably from inside storage area 3 to mixer 26 via the first plurality of pipelines 22, water pumps 21, and valves 16; the icy condensate is mixed in mixer 26 with the snow/ice coolant from at least one outside snow/ice collector 25 to make a snow/ice/condensate mixture; the snow/ice/condensate mixture is pumped via storage pump 34 and storage pipeline 35 from mixer 26 to inside storage area 3; near inside storage area 3, snow/ice/condensate separator 27 separates snow/ice/condensate mixture into the snow/ice coolant and the icy condensate prior to storage of the snow/ice in an upper, snow/ice section of inside storage area 3, and the icy condensate in a lower, condensate section of inside storage area 3.

Spillway basin 4 collects and stores return condensate (which is pumped from customers of cold and heat via preferably the second plurality of pipelines 33) and also annual precipitation from the vicinity of spillway basin 4.

A mud is caught from condensate and precipitation by filters 15 after condenser well 12, inside storage area 3, spillway basin 4, and system customers of cold and heat in order to protect feed-water from impurities.

The first plurality of water pumps 21, pipelines 22, valves 16, and filters 15 is used to pump icy condensate from inside storage area 3 to system customers of cold, at warm weathers. The same first plurality of water pumps 21, pipelines 22, valves 16 may be used to pump hot condensate from steam-extraction heater 14 of turbine 1 or from boiler 29 to system customers of heat, at cold weathers.

The third plurality of pipelines 32 with associated water pumps 21, valves 16, filters 15, and water inlets 18 is used to pump condensate and/or rain precipitation from preferably a top (the warmest) portion of spillway basin 4 to system customers of condensate.

The removal of condensate from the system by customers of condensate is preferably facilitated directly from the second plurality of pipelines 33.

The inside storage area 3 is preferably dividable by floating partition 17 e.g. with holes, into an upper, snow/ice section and a lower, condensate section in order to decrease snow/ice coolant losses through absorption of the icy condensate into the snow/ice within inside storage area 3, and to drain from the snow/ice coolant a water occured after partial melting of snow/ice in inside storage area 3 after snow/ice/icy condensate separator 27.

The floating partition 17 is preferably removed by lowering and fixing the floating partition 17 near a bottom of inside storage area 3, when outside temperatures fall below freezing, permitting an additional heat transfer between the icy condensate within inside storage area 3 and the surrounding environment outside the system by mixing icy condensate with snow/ice, thereby freezing the icy condensate to ice, and accumulating ice within inside storage area 3 to be used in the future;

when partition 17 is removed, icy condensate from condenser well 12 goes in an upper, snow/ice section of inside storage area 3 to be frozen immediately.

A plurality of demountable thermoinsulated roofs 10 is preferably provided, each of thermoinsulated roofs 10 covering preferably inside storage area 3, spillway basin 4, and at least one outside snow/ice collector 25 in order to reduce cold and condensate losses;

the plurality of thermoinsulated roofs 10 from inside storage area 3, spillway basin 4, and at least one outside snow/ice collector 25 is preferably demounted when outside temperatures fall below freezing, permitting accumulation of snow/ice and cold for use in the future;

warm return condensate is directed to boiler-feed pump 23 from second plurality of pipelines 33 with associated valves 16, not from spillway basin 4, when the roof 10 is demounted from spillway basin 4, for use of the warmest feed-water for boiler 29 and turbine's steam-extraction heater 14.

Although the invention has been described in specific terms, it will be understood that various changes may be made in size, shape, and materials, and in the arrangement of the parts without departing from the spirit and scope of the invention as claimed. Such modifications within the spirit and scope of the present invention will suggest themselves to those familiar with heat exchange and heat recovery systems.

Having thus set forth the nature of the present invention, what is claimed herein is:

1. A system for direct-contact condensation, comprising at least one outside snow/ice collector accumulating and storing a snow/ice coolant in form of snow, atmospheric ice, and condensate;

a condenser well collecting icy condensate;

an inside storage area for receiving said snow/ice coolant and said icy condensate from said at least one outside snow/ice collector and from said condenser well, said inside storage area also receiving snow precipitation from the vicinity of the plant and a outside snow/atmospheric ice delivery to the plant from cities, towns, roads, and other sources, said inside storage area and said at least one outside snow/ice collector being arranged to accumulate, exchange, and store said snow/ice and said icy condensate;

a spillway basin, accumulating and storing return condensate from said system and precipitation from the vicinity of said spillway basin;

a loader;

a bulk-load conveyor, said loader loading said snow/ice coolant from said inside storage area onto said bulk-load conveyor;

a grinder making an ice powder from said snow/ice coolant;

a hard foreign matter separator, said bulk-load conveyor and said outside snow/atmospheric ice delivery delivering said snow/ice coolant to said separator, separating said foreign matter from said snow/ice coolant and inhibiting said foreign matter from entering said grinder and the system after said grinder;

a plurality of ice sprayers;

a turbine having a last stage and a steam-extraction heater, or other heat-and-mass transfer equipment having a condenser;

a boiler for producing steam for delivery to said turbine, or other heat-and-mass transfer equipment having a condenser, and for producing hot condensate for delivery to customers of heat;

said condenser receiving exhaust steam from said turbine, or said other heat-and-mass transfer equipment having a condenser, said plurality of ice sprayers receiving said ice powder from said grinder and spraying said ice powder into said exhaust steam in said condenser, and, in the case of existing, already installed turbines for receiving undercritical steam velocities at an overload, into said last stage of said turbine, to thereby form a vacuum and icy condensate;

a vacuum exhaust pump/air ejector for evacuating cold air from said condenser in order to support a vacuum in said condenser, and to use said cold air as a coolant for air-conditioning;

a condensate pump in fluid communication with said condenser well and said inside storage area in order to pump said icy condensate from said condenser well to said inside storage area via a condenser pipeline;

a boiler-feed pump for delivery of condensate to said boiler via a deaerator excluding air from said condensate, and to water sprayers of said steam-extraction heater; and filters removing a mud from condensate and precipitation within said system after said condenser well, said inside storage area, said spillway basin, and customers of cold and heat, and before said boiler-feed pump.

2. The system of claim 1, further including a first plurality of pipelines, water pumps, valves, and water inlets in fluid communication with said inside storage area and customers of cold and heat, said first plurality of pipelines also in fluid communication with said steam-extraction heater, said boiler, and said at least one outside snow/ice collector in order to deliver said icy condensate from said inside storage area to said system customers of cold at warm weathers, to said at least one outside snow/ice collector, and to deliver hot condensate from said boiler or said steam-extraction heater to said customers of heat, at cold weathers;

a second plurality of pipelines with associated water pumps, valves, filters in fluid communication with said customers of cold and heat, said spillway basin, and said boiler-feed pump in order to deliver return condensate from said customers of cold and heat to said spillway basin and to said boiler-feed pump;

a third plurality of pipelines with associated water pumps, valves, filters, and water inlets in fluid communication with said spillway basin and customers of condensate in order to deliver said condensate from said spillway basin to said customers of condensate; said condensate also being removable by said customers of condensate directly from said second plurality of pipelines;

a fourth plurality of pipelines and valves, delivering condensate from said spillway basin or said second plurality of pipelines to said boiler-feed pump and said boiler via said deaerator, and to water sprayers of said steam-extraction heater.

3. The system according to claim 2, further comprising a mixer near said at least one outside snow/ice collector, mixing said icy condensate from said first plurality of pipelines with said snow/ice from said outside snow/ice collectors, a storage pump, a storage pipeline with associated valves, connecting for snow/ice delivery said outside snow/ice collector to said inside storage area via said mixer and a snow/ice/icy condensate separator near said inside storage area separating said snow/ice coolant from icy condensate prior to storage of said snow/ice in an upper, snow/ice section of said inside storage area, and said icy condensate in a lower, condensate section of said inside storage area when said system needs an additional portion of said snow/ice coolant for a normal operation.

4. The system according to claim 3, wherein said turbine, said steam-extraction heater, said boiler, said deaerator, said condenser, said condenser well, said condensate pump, said condenser pipeline, said vacuum exhaust pump/air ejector, said bulk-load conveyor, said grinder, said hard foreign matter separator, said ice sprayers, said at least one outside snow/ice collector, said inside storage area, said mixer, said storage pump, said snow/ice/icy condensate separator, said first plurality of pipelines with associated water pumps, valves and filters, and said storage pipeline with associated valves are thermoinsulated in order to reduce cold and heat losses from said system.

5. The system according to claim 1, wherein said inside storage area is divided by a floating partition into said upper, snow/ice section and said lower, condensate section in order to decrease snow/ice losses through absorption of icy condensate into said snow/ice coolant.

6. The system according to claim 5, wherein when temperatures outside said system fall below freezing, said floating partition is lowered and fixed near a bottom of said inside storage area, permitting an additional heat transfer between icy condensate within said inside storage area and the surroundings outside said system by mixing said icy condensate with said snow/ice coolant, thereby accumulating ice within said inside storage area to be used in the future;

when said floating partition is lowered, icy condensate from said condenser well is directed to said upper section of said inside storage area to be frozen immediately.

7. The system according to claim 1, wherein a total volume of said snow/ice coolant in said inside storage area, in said at least one outside snow/ice collector, and from said outside snow/atmospheric ice delivery to the system is not less than a snow/atmospheric ice amount necessary to run said system said for one year.

8. The system according to claim 1, wherein said inside storage area and said spillway basin are interconnected to permit condensate and snow/ice exchange.

9. The system according to claim 8, wherein excess condensate is taken from said spillway basin or from said second plurality of pipelines for delivery to customers of condensate for plant, industrial, service, domestic, and water-supply needs.

10. The system according to claim 8, wherein excess condensate is taken from said inside storage area via said first plurality of pipelines with associated water pumps, water inlets, and valves for delivery to said at least one outside snow/ice collector to be frozen to ice during cold weathers below freezing, and to be used as said snow/ice coolant in the future.

11. The system according to claim 1, wherein said inside storage area, spillway basin, and at least one outside snow/ice collector are covered with demountable thermoinsulated roofs in order to reduce cold and condensate losses from said system.

12. The system according to claim 11, wherein when temperatures outside said system fall below freezing, said roofs may be demounted in to permit accumulation of said snow/ice coolant for use in the future.

13. The system according to claim 12, wherein when said roof is demounted from said spillway basin, warm return condensate is directed to said fourth plurality of pipelines only from said second plurality of pipelines with associated valves, for use of the warmest feed-water in said boiler and said steam-extraction heater.

14. The system according to claim 1, wherein said steam-extraction heater is a direct-contact heat exchanger, exchanging heat between steam extracted from said turbine and condensate delivered to said water sprayers by said boiler-feed pump.

15. A method for direct-contact condensation comprising the steps of:

collecting a snow/ice coolant in the form of snow, atmospheric ice, and icy condensate within at least one outside snow/ice collector and an inside storage area;

transporting said snow/ice coolant from said at least one outside snow/ice collector to said inside storage area when an additional portion of said coolant is needed for normal direct-contact condensation operation;

loading via a loader said snow/ice coolant from said inside storage area onto a bulk-load conveyor;

conveying said snow/ice coolant via said bulk-load conveyor or via delivery from cities, towns, roads, and other sources to a hard foreign matter separator;

separating said foreign matter from said snow/ice coolant, and inhibiting said foreign matter from entering a grinder and said system after said grinder;

making an ice powder in said grinder from said snow/ice coolant;

condensing the exhaust steam of a turbine or other heat-and-mass transfer equipment having a condenser, by spraying said ice powder into a condenser associated with said turbine or other heat-and-mass transfer equipment having a condenser, and, in case of existing, already installed steam turbines for receiving under-critical steam velocities at an overload, into at least one last stage of said turbine, to thereby form a vacuum and icy condensate;

collecting said icy condensate created during condensation, from said condenser in a condenser well;

evacuating cold air said from said condenser via a vacuum exhaust pump/air ejector for support of a vacuum inside of said condenser, and for use of said cold air for air-conditioning plant buildings, said bulk-load conveyor, and said inside storage area;

pumping said icy condensate from said condenser well to said inside storage area via a filter for removing a mud, a condensate pump, and a condenser pipeline;

producing steam and hot condensate in a boiler for later use in said turbine; and excluding air from said condensate in a deaerator before said boiler.

16. The method described in claim 15, further comprising the steps of:

providing a spillway basin;

collecting and storing a return condensate from a second plurality of pipelines and precipitation from the vicinity of said spillway basin;

pumping said return condensate or rain precipitation from said spillway basin or said return condensate from said second plurality of pipelines to a boiler-feed pump, and then to said deaerator, said boiler, and to water sprayers of a steam-extraction heater via a fourth plurality of pipelines and valves;

pumping icy condensate from said inside storage area to customers of cold via a first and a second pluralities of pipelines with associated water pumps, valves, and filters, at warm weathers;

pumping hot condensate from said steam-extraction heater or said boiler to customers of heat via said first and second pluralities of pipelines, water pumps, valves, and filters, at cold weathers;

pumping condensate and precipitation from said spillway basin to customers of condensate via a third plurality of pipelines with associated water pumps, valves, filters, and water inlets;

facilitating the removal of condensate from said system by customers of condensate directly from said second plurality of pipelines; and catching a mud from said condensate and precipitation by said filters after said condenser well, said inside storage area, said spillway basin, and customers of cold and heat, thereby ensuring a feed-water and pipelines' protection from impurities.

17. The method described in claim 16, further comprising the steps of:

providing a plurality of thermoinsulated roofs, each of said thermoinsulated roofs covering said inside storage area, said spillway basin, and said at least one outside snow/ice collector in order to reduce cold and condensate losses;

demounting said plurality of thermoinsulated roofs from said inside storage area, said spillway basin, and said at least one outside snow/ice collector, when outside temperatures fall below freezing, thereby permitting accumulation of snow/ice coolant for use in the future; and directing warm return condensate, after demounting said thermoinsulated roofs from said spillway basin, to said boiler-feed pump via said fourth plurality of pipelines and valves only from said second plurality of pipelines, water pumps, and valves for use of the warmest condensate in said boiler and said steam-extraction heater.

18. The method described in claim 15, wherein said inside storage area is dividable by a floating partition into an upper, snow/ice section and a lower, condensate section in order to decrease snow/ice coolant losses through absorption of icy condensate into snow/ice within said inside storage area.

19. The method described in claim 18, further comprising the steps of:

lowering and fixing said floatable partition near a bottom area of said inside storage area, when outside temperatures fall below freezing, permitting an additional heat transfer between icy condensate within said inside storage area and surrounding environment outside said system by mixing said icy condensate with snow/ice, thereby accumulating ice within said inside storage area to be used in the future; and directing icy condensate from said condenser well to said upper section of said inside storage area to be frozen immediately, when said floating partition is lowered.

20. The method described in claim 15, further comprising the steps of:

providing a mixer near said at least one outside snow/ice collector, a storage pump, a storage pipeline with associated valves for snow/ice delivery to said inside storage area when an additional portion of said snow/ice coolant is needed for normal direct-contact condensation operation;

pumping icy condensate from said inside storage area to said mixer via said first plurality of pipelines, water inlets, water pumps, and valves;

mixing said icy condensate in said mixer with said snow/ice coolant from said at least one outside snow/ice collector in order to make a snow/ice/icy condensate mixture;

pumping said snow/ice/icy condensate mixture via said mixer, storage pump, and storage pipeline with associated valves from said mixer to a snow/ice/icy condensate separator near said inside storage area; and separating in said snow/ice/icy condensate separator said mixture into snow/ice coolant and icy condensate prior to storage of said snow/ice coolant in said upper section of said inside storage area, and icy condensate in said lower section of said inside storage area.

* * * * *